US005524455A

United States Patent [19]

Hasegawa et al.

[11] Patent Number: 5,524,455

[45] Date of Patent: Jun. 11, 1996

[54] EVAPORATOR FOR COOLING UNITS

[75] Inventors: Etsuo Hasegawa, Kohnan; Yasushi Yamanaka, Nakashima-gun; Yoshiyuki Yamauchi, Chita-gun; Masahiro Shimoya, Chiryu; Toshio Ohara, Kariya; Yoshiharu Kajikawa, Hekinan; Toshihiro Yamamoto, Gifu; Kenichi Fujiwara, Kariya; Shin Nishida, Anjo; Yoshiaki Takano, Obu; Nobuharu Kakehashi, Anjo, all of Japan

[73] Assignee: Nippondenso Co., Ltd., Kariya, Japan

[21] Appl. No.: 414,057

[22] Filed: Mar. 30, 1995

Related U.S. Application Data

[63] Continuation of Ser. No. 232,273, filed as PCT/JP93/01327, Sep. 16, 1993, published as WO94/07091, Mar. 31, 1994, abandoned.

[30] Foreign Application Priority Data

Sep. 17, 1992 [JP] Japan ..... 4-248065
Sep. 3, 1993 [JP] Japan ..... 5-220029

[51] Int. Cl.[6] ..... F25B 41/00; F25B 41/06

[52] U.S. Cl. ..... 62/513; 62/527

[58] Field of Search ..... 62/199, 513, 527

[56] References Cited

U.S. PATENT DOCUMENTS

| | | | |
|---|---|---|---|
| 4,589,265 | 5/1986 | Nozawa | 62/527 X |
| 4,621,501 | 11/1986 | Tanaka | 62/199 |
| 4,959,972 | 10/1990 | Lowes | 62/200 |
| 5,245,843 | 9/1993 | Shimoya et al. | 62/513 X |
| 5,390,507 | 2/1995 | Shimoya et al. | 62/513 X |

FOREIGN PATENT DOCUMENTS

| | | |
|---|---|---|
| 497339 | 8/1992 | European Pat. Off. . |
| 611926 | 8/1994 | European Pat. Off. . |
| 49-536 | 1/1974 | Japan . |
| 52-123364 | 9/1977 | Japan . |
| 53-47647 | 4/1978 | Japan . |
| 54-80063 | 6/1979 | Japan . |
| 58-41429 | 9/1983 | Japan . |
| 263146 | 12/1990 | Japan . |

OTHER PUBLICATIONS

"Refrigeration System" Journal of Nippondenso Tech. Disclosure, Mar. 1985.

*Primary Examiner*—William E. Wayner
*Attorney, Agent, or Firm*—Cushman, Darby & Cushman

[57] ABSTRACT

An amount of refrigerant fed to an evaporator 16 is adjusted by an open degree of an expansion valve 6 in accordance to a refrigerant pressure and a refrigerant temperature of an outlet side of the evaporator 16. The evaporator 16 has an evaporation part which includes a refrigerant passage 26 connecting parallel with an inflow passage 22 and an outflow passage 24 and further having a cooled passage 28 which forms a first throttle 30 at the downstream thereof and a cooling passage 32. The cooled passage 28 links the expansion valve 6 and the inflow passage 22. The cooling passage 32 is connected to the outflow passage 24 and leads refrigerant to an outlet. A heat exchange part 20 is provided to be able to of performing heat exchange between the cooled passage 28 and the cooling passage 32. A second throttle is set in a bypass passage 38 which links the upstream side of the cooled passage 28 and the downstream side of the first throttle 30.

19 Claims, 36 Drawing Sheets

EVAPORATOR FOR COOLING UNITS

This is a continuation of application Ser. No. 08/232,273, filed as PCT/JP93/01327 on Sep. 16, 1993, published as WO94/07091 on Mar. 31, 1994, which was abandoned upon the filing hereof 08/232,273.

BACKGROUND OF THE INVENTION

1. Field of the Invention

The present invention generally relates to an evaporator for cooling units used for refrigerating cycles. More particularly, the present invention relates to an evaporator for cooling units connected in parallel with a plurality of refrigerant passages.

2. Description of Related Art

An evaporator has been devised heretofore for use in cooling units, in which a core composed of stacked two pieces of flat core plates to form a refrigerant passage and a fit are alternatively stacked for a plurality of units. However, the evaporator in this arrangement is uneven in the distribution of refrigerant to each refrigerant passage. In an attempt to solve this problem, an evaporator as disclosed in the Japanese Examined Patent Publication No. 58-41429, for example, is known. In this evaporator, a long and narrow micro-passage working as a fixed throttles is formed at each core plate. Refrigerant condensed into a liquid refrigerant by a condenser is fed into the evaporator as it is, and then distributed to each refrigerant passage at an even flow rate with the fixed throttles of each core so that the pressure of the refrigerant is reduced thereby.

On the other hand, an evaporator provided with a heat exchange part for heat exchange between a high-temperature pipe of the receiver outlet side, and a low-temperature pipe between the evaporator and a thermo-sensing tube to minimize the gaseous refrigerant which does not participate in cooling performed in the downstream from a receiver and to increase the effective refrigerant (i.e., supercooling) has been proposed (as disclosed in the Nippondenso Technical Disclosure Bulletin No. 40-076, issued on Mar. 15, 1985).

However, in these conventional evaporators with a fixed throttle, when refrigerant in gas-liquid two phase state flows into the fixed throttle, the even distribution of the refrigerant can not be achieved. Namely, there are two types of fixed throttles; one through which gaseous refrigerant mainly flows, and the other through which liquid refrigerant mainly flows.

Accordingly, it is conceivable that the evaporator with fixed throttles is used for the refrigerating cycle, the refrigerant after the receiver is cooled at the heat exchange part by the low-temperature refrigerant flowed through the evaporator so that the refrigerant is supercooled, whereby the liquid refrigerant is increased to make the distribution of the refrigerant by the fixed throttle more even.

However, when the indoor temperature is higher than the outdoor temperature as it is in the winter season and the temperature of the air to cool the condenser is as low as 0° to 10° C., or when the volume of the refrigerant to be fed into the evaporator is not sufficient due to the insufficient volume of the refrigerant within the receiver as it is in the transient operation state, there are some cases where the temperature at the outlet of the evaporator rose and the cooling of the refrigerant at the heat exchange part was not performed sufficiently. Furthermore, when the temperature of the refrigerant at the outlet of the evaporator is higher than that of the refrigerant flowed through the receiver, there are some cases where the refrigerant flowed through the receiver is evaporated and the performance of the evaporator is substantially reduced.

Moreover, in the above evaporator, the fixed throttles are formed in the two pieces of flat core plates having a recess part. In order to attain an even distribution of the refrigerant, however, the cross-sectional profiles of these fixed throttles must be exactly aligned with one another, otherwise, uneven distribution of the refrigerant may result. For example, if these two flat core plates are connected to each other by brazing, brazing filler metal may flow into the fixed throttles, causing a manufacturing problem in that it is difficult to produce fixed throttles which are exactly aligned with one another.

Accordingly, a primary objective of the present invention is to solve the above problems and provide an evaporator for cooling units which can evenly distribute the refrigerant to each refrigerant passage without causing any performance degradation.

SUMMARY OF THE INVENTION

In order to achieve the above objective and as a means to solve the above problems, the present invention is arranged as follows:

In an evaporator for a cooling unit to be installed in the downstream from a pressure reducing valve in a refrigerating cycle for use in circulating refrigerant, the evaporator is provided with an evaporation part in which an inflow passage and an outflow passage are connected in parallel with each other through a plurality of refrigerant passages, and a heat exchange part formed so as to be capable of performing heat exchange between a cooled passage which is formed between the pressure reducing valve and the inflow passage, and a cooling passage which is connected to the outflow passage and leads the refrigerant to an outlet, and further provided with a first throttle set in the refrigerant passage downstream from the cooled passage of the heat exchange part, and a second throttle set in a bypass passage which detours at least the heat exchange part and the first throttle.

It may also be arranged that the bypass passage is branched from between the pressure reducing valve and the heat exchange part, that the bypass passage is branched from the upstream from the pressure reducing valve, or that a switch valve which can close when the pressure difference between the upstream side and the downstream side exceeds a preset amount is set in the bypass passage. Furthermore, it may also be arranged that a gas-liquid separator which separates the refrigerant in the gas-liquid two phase state into a gaseous refrigerant and a liquid refrigerant is set in the cooled passage between the pressure reducing valve and the heat exchange part and connected in order that the liquid refrigerant separated by the gas-liquid separator can flow into the bypass passage.

Moreover, it may also be arranged that the bypass passage joins the cooled passage in the downstream from the first throttle so as to prevent the occurrence of the jet stream of the refrigerant flowed through the first throttle, or that a wall against which the jet stream of the refrigerant flowed through the first throttle collides is formed.

In the evaporator for cooling units in the above arrangement, the refrigerant flow is branched into the cooled passage and into the bypass passage by the first and second throttles respectively. Part of the refrigerant flows through the cooled passage is subjected to pressure reduction by the first throttle on one hand, and the refrigerant flows into the bypass passage is subjected to pressure reduction by the second throttle on the other hand. Then, these two flows of the refrigerant join together and flow into the inflow passage of the evaporation part.

When the refrigerant is distributed from the inflow passage to each refrigerant passage and flows through each refrigerant passage, heat exchange is made, and then the refrigerant flows from the outflow passage into the cooling passage. Heat exchange is made between the cooling passage and cooled passage of the heat exchange part, the refrigerant in the cooled passage is cooled, and liquefaction is promoted. Particularly when a cooling unit is operated in the winter season, as the pressure difference between the cooling passage and cooled passage of the heat exchange part is small, if the degree of heating of the refrigerant flowing into the cooling passage excessively increases, the refrigerant in the cooled passage will be heated, the volume of the refrigerant will increase, and the volume of the refrigerant flowing through the cooled passage will decrease, but the required volume of the refrigerant will be secured by the bypass passage.

When a switch valve which opens and closes a passage is mounted, if the pressure difference between the upstream and downstream from the bypass passage exceeds a certain preset amount due to a large load, the switch valve will close to shut off the bypass passage and subsequently the refrigerant will flow only into the cooled passage and the cooling performance will be improved.

When a gas-liquid separator is mounted, the gas-liquid separator separates the refrigerant in the gas-liquid two phase state into a gaseous refrigerant and a liquid refrigerant, the former flowing into the cooled passage and the latter into the bypass passage. Therefore, in the winter season, a higher volume of the refrigerant through the bypass passage can be secured.

When the bypass passage is connected so as to prevent the occurrence of the jet stream of the refrigerant, the occurrence of the jet stream of the refrigerant flowed through the first throttle is controlled, and consequently the occurrence of noise due to the jet stream can be prevented. When a wall against which the jet stream collides is formed, the occurrence of noise due to the jet stream of the refrigerant flowed through the first throttle can be prevented.

BRIEF DESCRIPTION OF THE DRAWINGS

FIG. 13 is an illustrative view illustrating the relation when the second capillary passage of the sixth embodiment is intermediately joined to the first capillary passage of the same embodiment;

DESCRIPTION OF THE PREFERRED EMBODIMENT

Embodiments of the present invention will now be described referring to the accompanying drawings.

Figure 1:
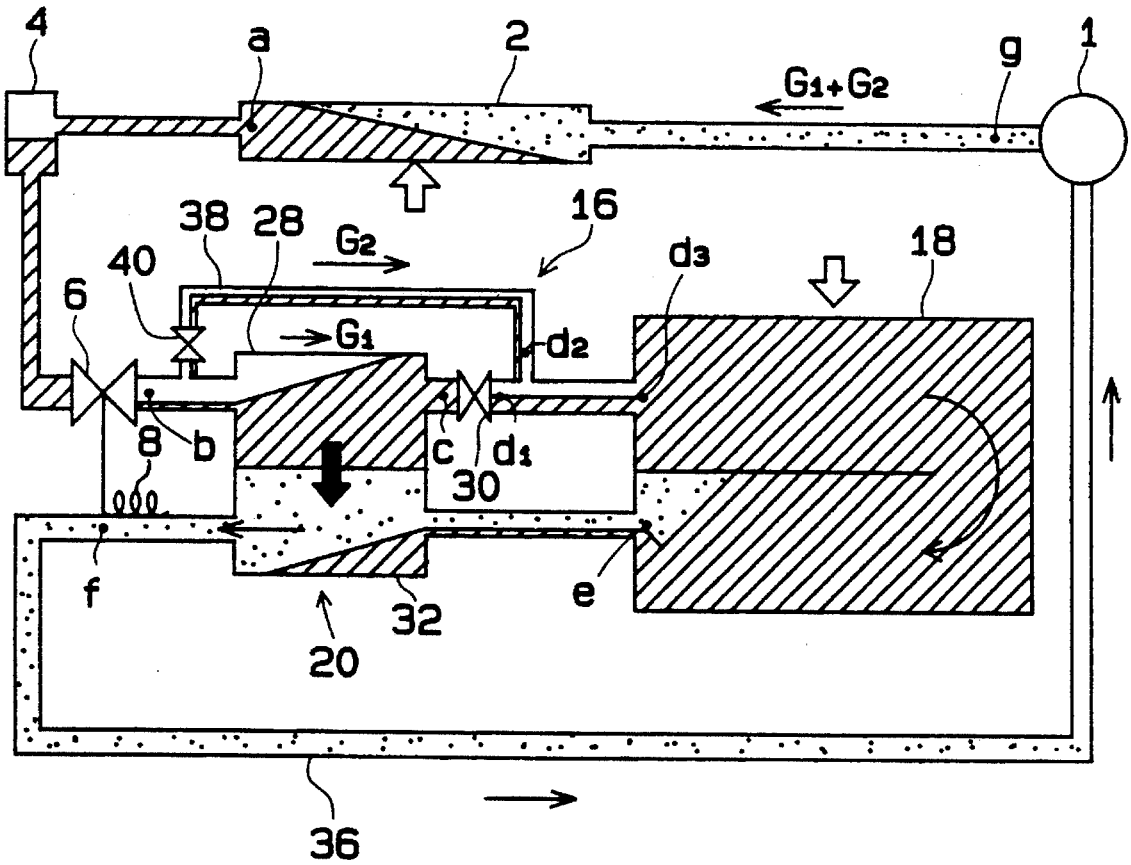
FIG. 1 is a schematic structural view illustrating a refrigerant cycle to which an evaporator for cooling units is applied as the first embodiment of the present invention.

FIG. 1 is a schematic structural view of a refrigerating cycle to which an evaporator is applied as an embodiment of the present invention. The numeral 1 denotes a compressor. When applied to a vehicle, the compressor 1 is driven to rotate by an internal combustion engine (not illustrated). The compressor 1 then compresses a gaseous refrigerant, and then feeds the same to a condenser 2. The condenser 2 cools the refrigerant by utilizing the external air into a liquid refrigerant, and then feeds the same to a receiver 4. The compressor 1, the condenser 2 and the receiver 4 are connected accordingly to achieve the above respective functions.

Figure 2:
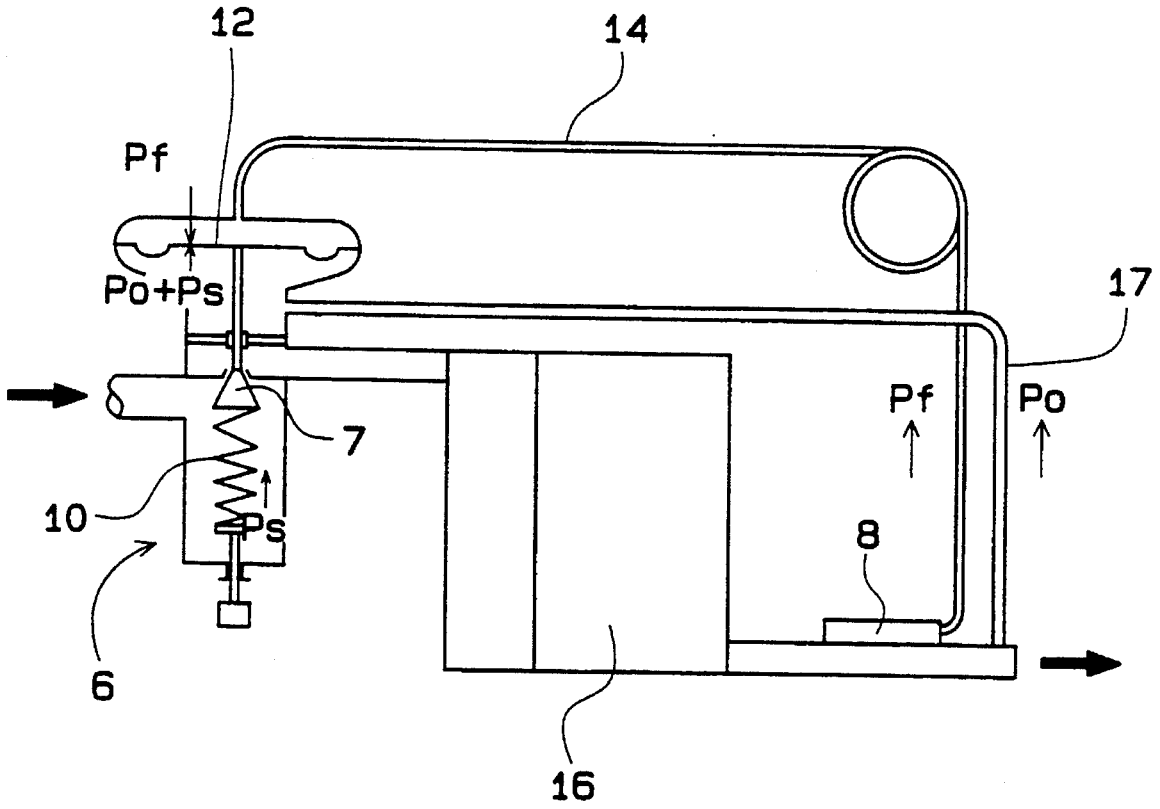
FIG. 2 is a schematic structural view illustrating an expansion valve of the first embodiment.

The receiver 4 is designed to temporarily store the refrigerant and, at the same time, remove dust and moisture from the refrigerant. The refrigerant is then fed out of the receiver 4 into an expansion valve 6. The expansion valve 6 is designed to reduce the pressure of the received refrigerant. As illustrated in FIG. 2, the expansion valve 6 is structured so that the opening thereof can be adjusted by the movement of a valve 7. Incidentally, the expansion valve 6 works as a pressure reducing valve in this embodiment. In this embodiment, however, the pressure reducing valve is not limited to opening adjustable type, but a fixed throttle valve is also possible.

In the expansion valve 6, the valve 7 is being energized in the valve closing direction by energizing force Ps of a spring 10, and, at the same time, one end of the valve 7 is connected onto a diaphragm 12. Furthermore, a thermo-sensing tube 9 is furnished in the downstream from an evaporator 16 (described later). When the temperature of the refrigerant in the downstream from the evaporator 16 rises, pressure Pf within the thermo-sensing tube 8 also rise, or cooling load increases. This pressure Pf acts on one side of the diaphragm 12 via a capillary tube 14 to shift the valve 7 in the valve opening direction and the opening is adjusted to increase the volume of the refrigerant.

The expansion valve 6 includes an outer pressure balancing pipe 17 to introduce refrigerant pressure PO in the downstream from the evaporator 16 into the other side of the diaphragm 12. In this arrangement, the opening made by the valve 7 compensates the refrigerant pressure PO and the refrigerant temperature in the downstream from the evaporator 16 by balancing among the energizing force Ps of the spring 10, the pressure PO from the outer balancing tube 17 and the pressure Pf from the capillary tube 14 to be Pf=Ps+PO.

Figure 3:
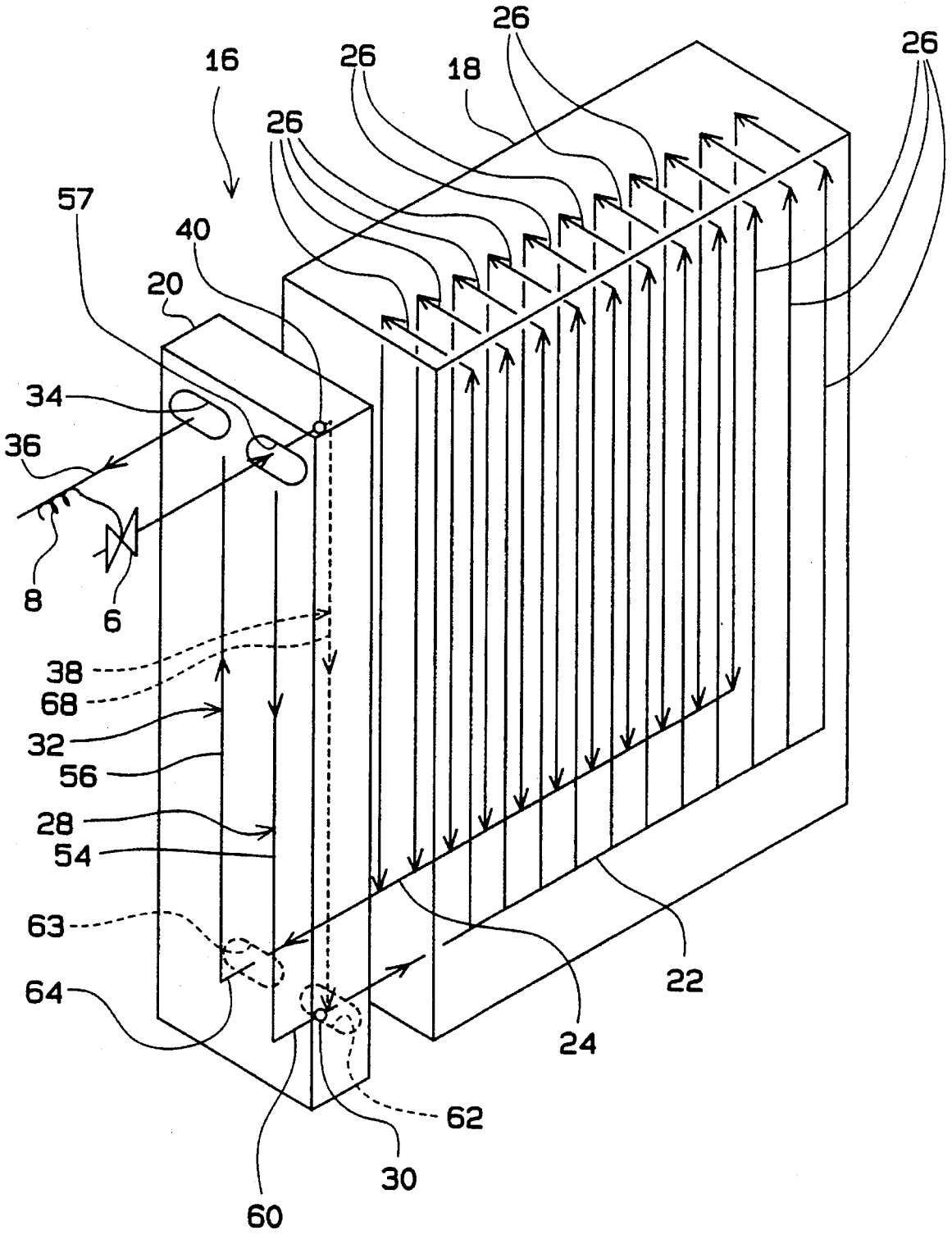
FIG. 3 is a perspective view illustrating the schematic structure of the evaporator of the first embodiment.

It is so connected that the refrigerant fed out of the expansion valve 6 is fed into the evaporator 16 and then, as a gaseous refrigerant, sucked into the compressor 1. The evaporator 16 includes an evaporation part 18 and a heat exchange part 20. As illustrated in FIG. 3, the evaporation part 18 includes an inflow passage 22 and an outflow passage 24, both of which are connected with each other through a refrigerant passage 26 so that heat exchange is made between the refrigerant flowing through the refrigerant passage 26 and the air supplied into the compartment.

On the other hand, a cooled passage 28 is provided to connect the expansion valve 6 with the inflow passage 22 of the evaporation part 18, and a first throttle 30 is provided downstream from the cooled passage 28. Furthermore, a cooling passage 32 is provided, one end of which is connected to the outflow passage 24 of the evaporation part 18 and the other side of which is connected to an exhaust passage 36 through an outlet port 34. The heat exchange part 20 is formed to make heat exchange between the refrigerant in the cooled passage 28 and that in the cooling passage 32, both of which are in the upstream from the first throttle 30.

The exhaust passage 36 includes the thermo-sensing tube 8 and the outer balancing pipe 17. The exhaust passage 36 is connected so as to introduce the refrigerant exhausted from the outlet port 34 into the compressor 1.

Furthermore, one end of a bypass passage 38 is connected to the cooled passage 28 disposed between the expansion valve 6 and the heat exchange part 20 to branch the cooled passage 28. The other end of the bypass passage 38 is connected to the cooled passage 28 in the downstream from the first throttle 30 to join the cooled passage 28. On the other hand, a second throttle 40 is installed in the bypass passage 38.

The specific structure of the above described evaporator 16, particularly that of the heat exchange part 20 will next be described referring to FIGS. 4 through 9.

Figure 4:
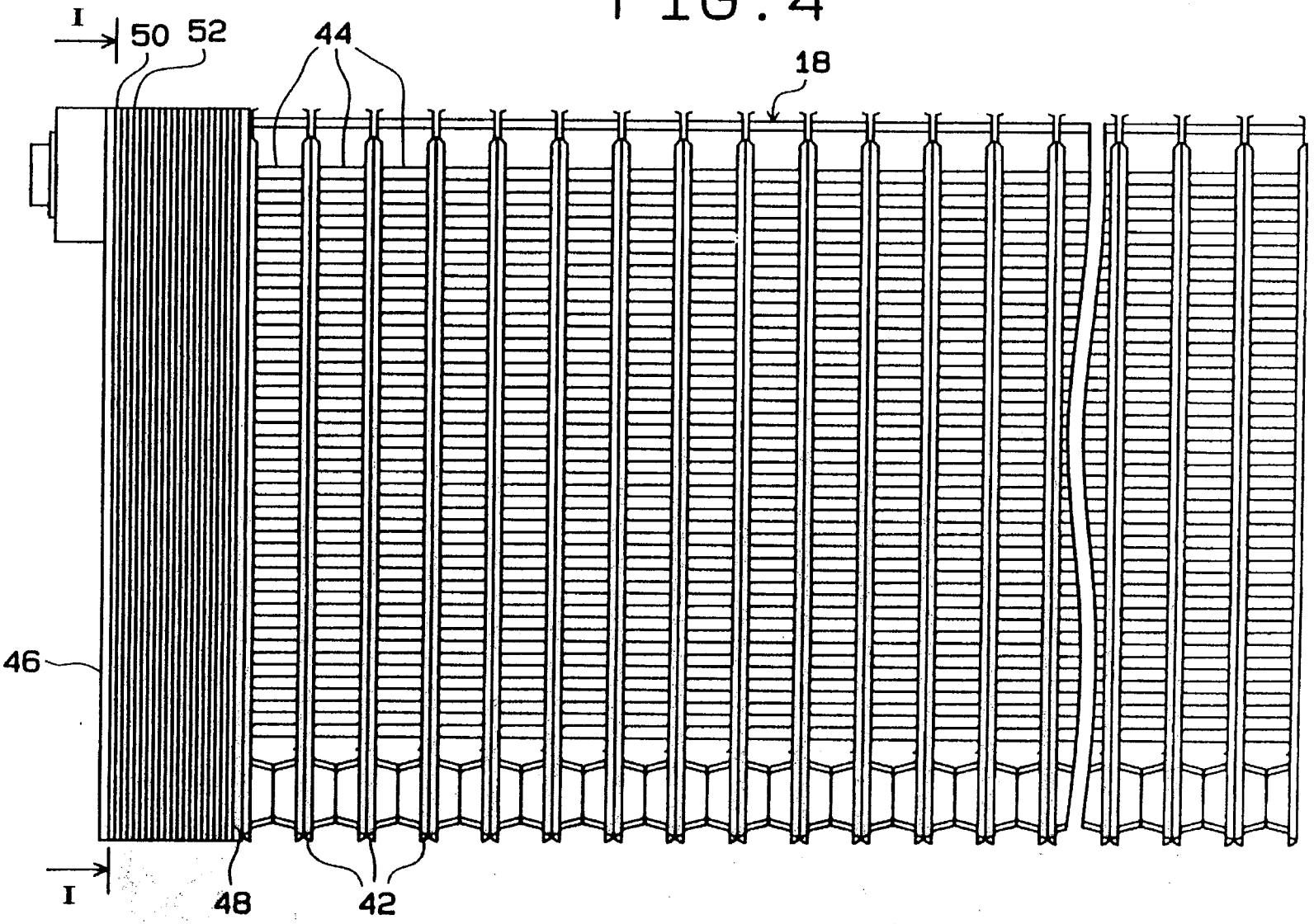
FIG. 4 is a side view illustrating the evaporator of the first embodiment.

As illustrated in FIG. 4, a plurality of core plates 42, in which the refrigerant passage 26 is formed, are stacked with a plurality of fins therebetween to form the evaporation part 18. A plurality pairs of first and second plates 50 and 52 are alternatively stacked between first and second side plates 46 and 48, whereas a pair of first and second plates 50 and 52 are symmetrical.

Figure 8:
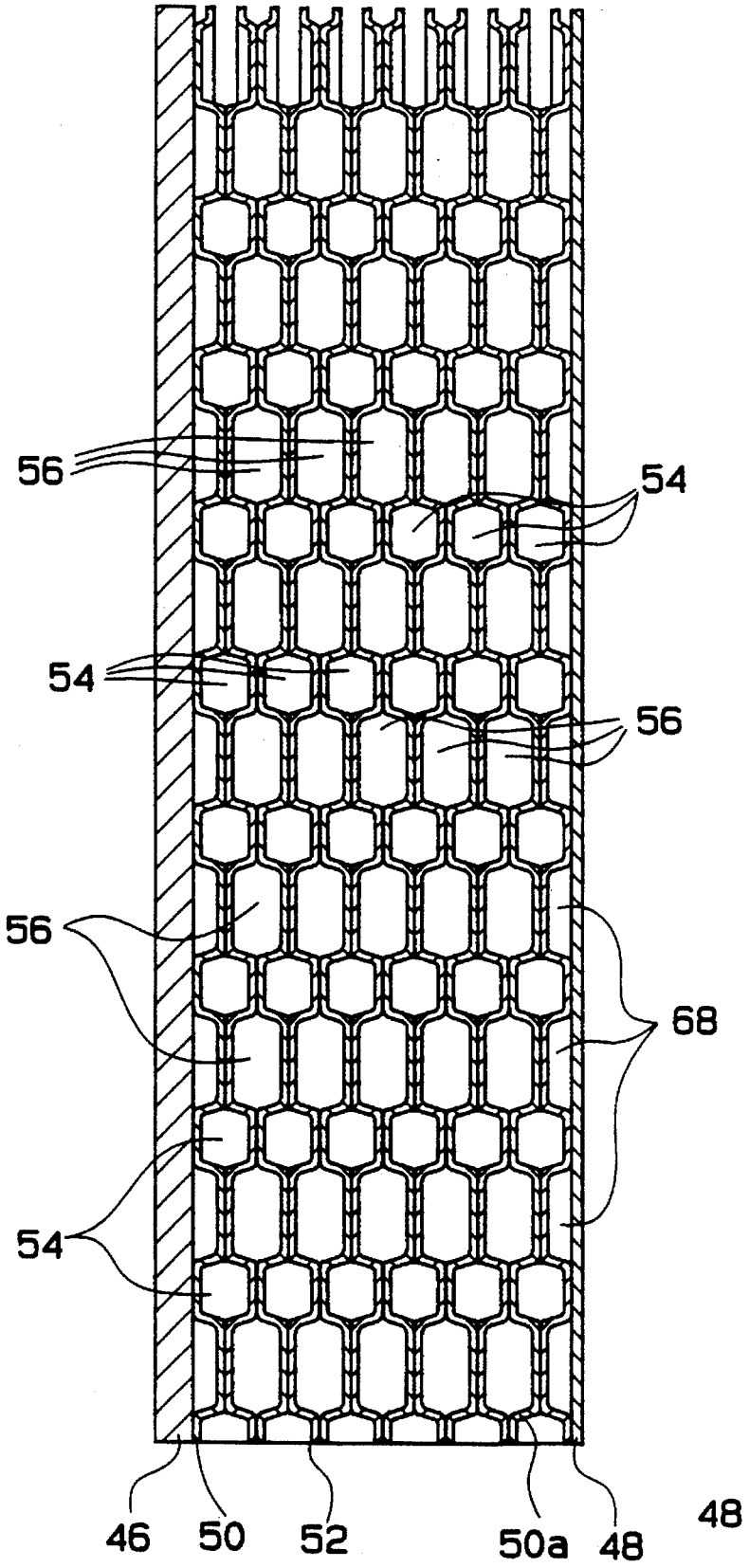
FIG. 8 is an expanded cross-sectional view taken along line III—III of FIG. 5.

The first and second plates 50 and 52 have a numerosity of convex parts and concave parts, and alternatively stacked to form a numerosity of first passage 54 between the insides of the first plates 50 and the insides of the second plates 52 as shown in FIG. 8. In the same way, a numerosity of second passage 56 are formed between the outsides of the second plates 52 and the outsides of the first plates 50.

Figure 5:
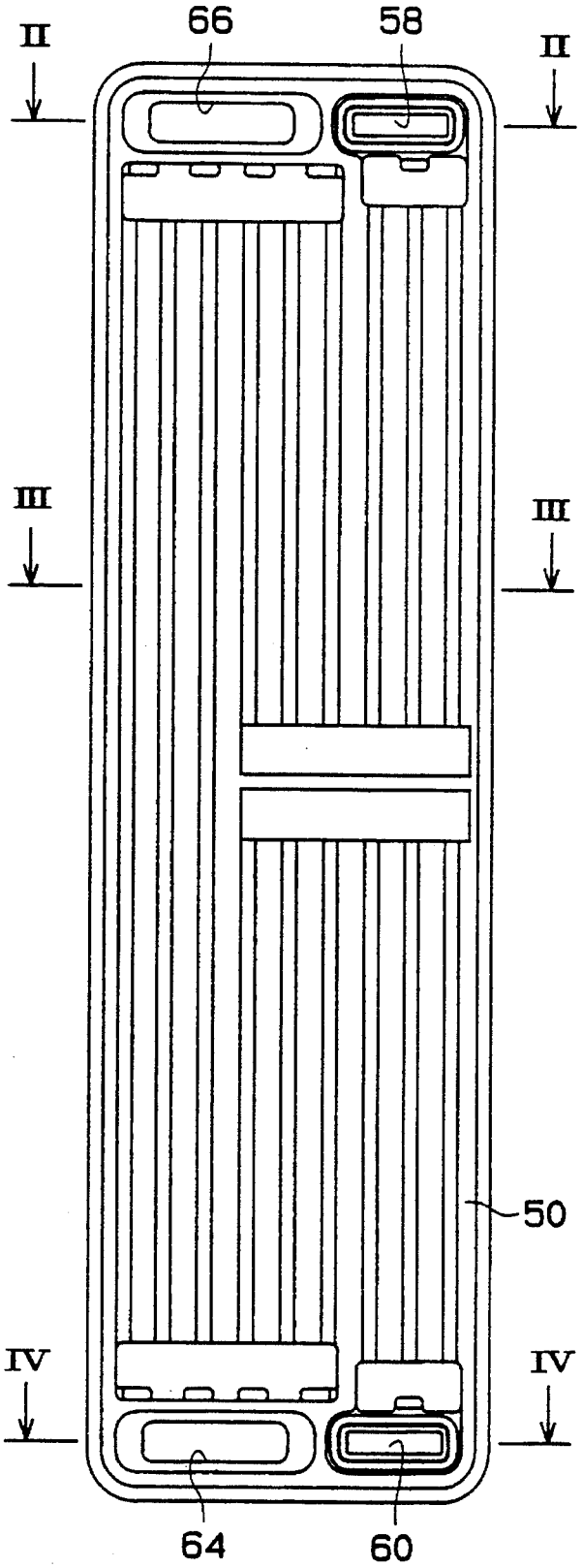
FIG. 5 is an expanded cross-sectional view taken along line I—I of FIG. 5.
Figure 6:
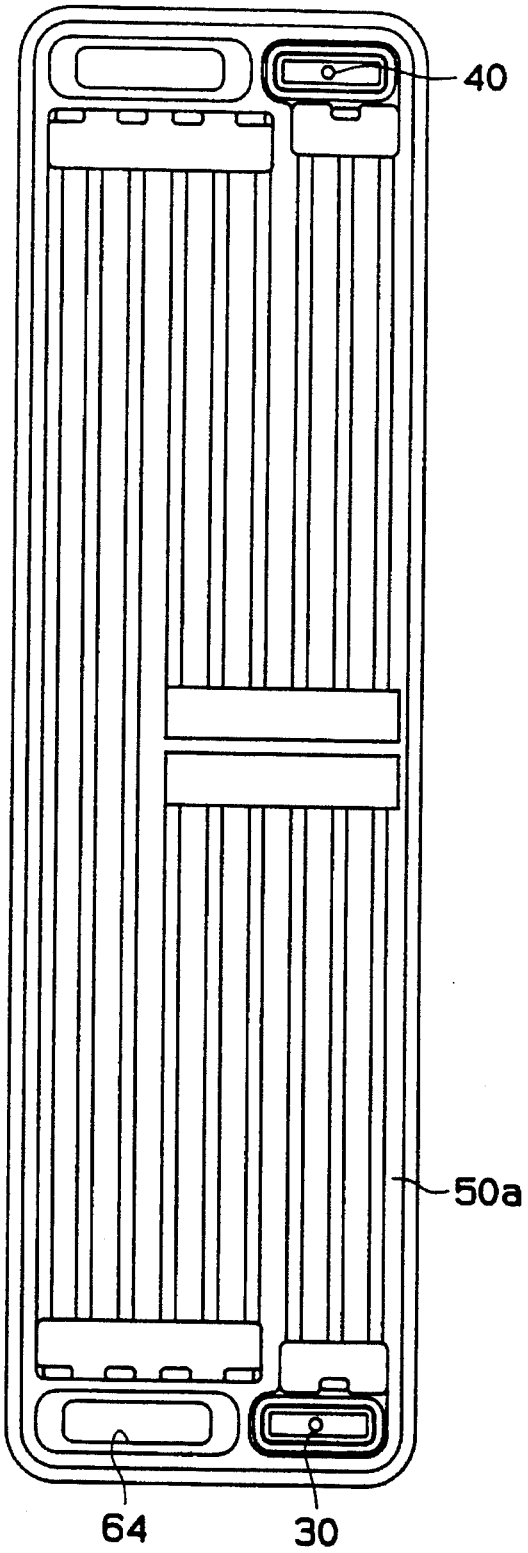
FIG. 6 is an expanded front view illustrating a second plate of the first embodiment.
Figure 7:
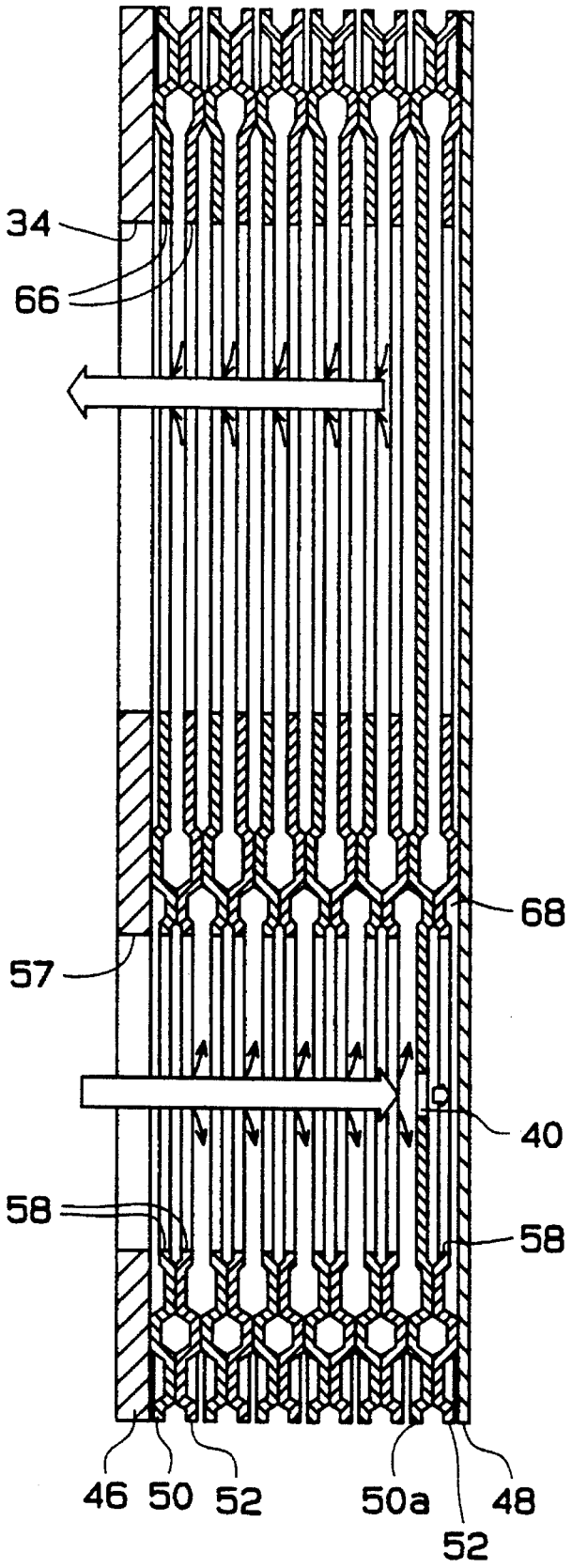
FIG. 7 is an expanded cross-sectional view taken along line II—II of FIG. 5.

As illustrated in FIGS. 5 and 7, an inlet port 57 and an inflow port 58 are formed at the upper part of the first side plate 46 and some of the first plates 50. The inflow port 58 is linked with the first passage 54, while the first passage 54 is connected to a first link port 60 formed at the lower part of the first and second plates 50 and 52.

Of all the first plate 50, a piece of first plate 50*a* provided at the side of the second side plate 48 includes a first throttle 30 composed of an orifice instead of the first link port 60. The first throttle 30 is connected with the inflow passage 22 of the evaporation part 18 through the first link port 60 formed at the second plate 52 and a first connection port 62 formed at the second side plate 48. The inflow port 58, the first passage 54, the first link port 60 and the first connection port 62 compose the cooled passage 28 illustrated in FIG. 3.

Figure 9:
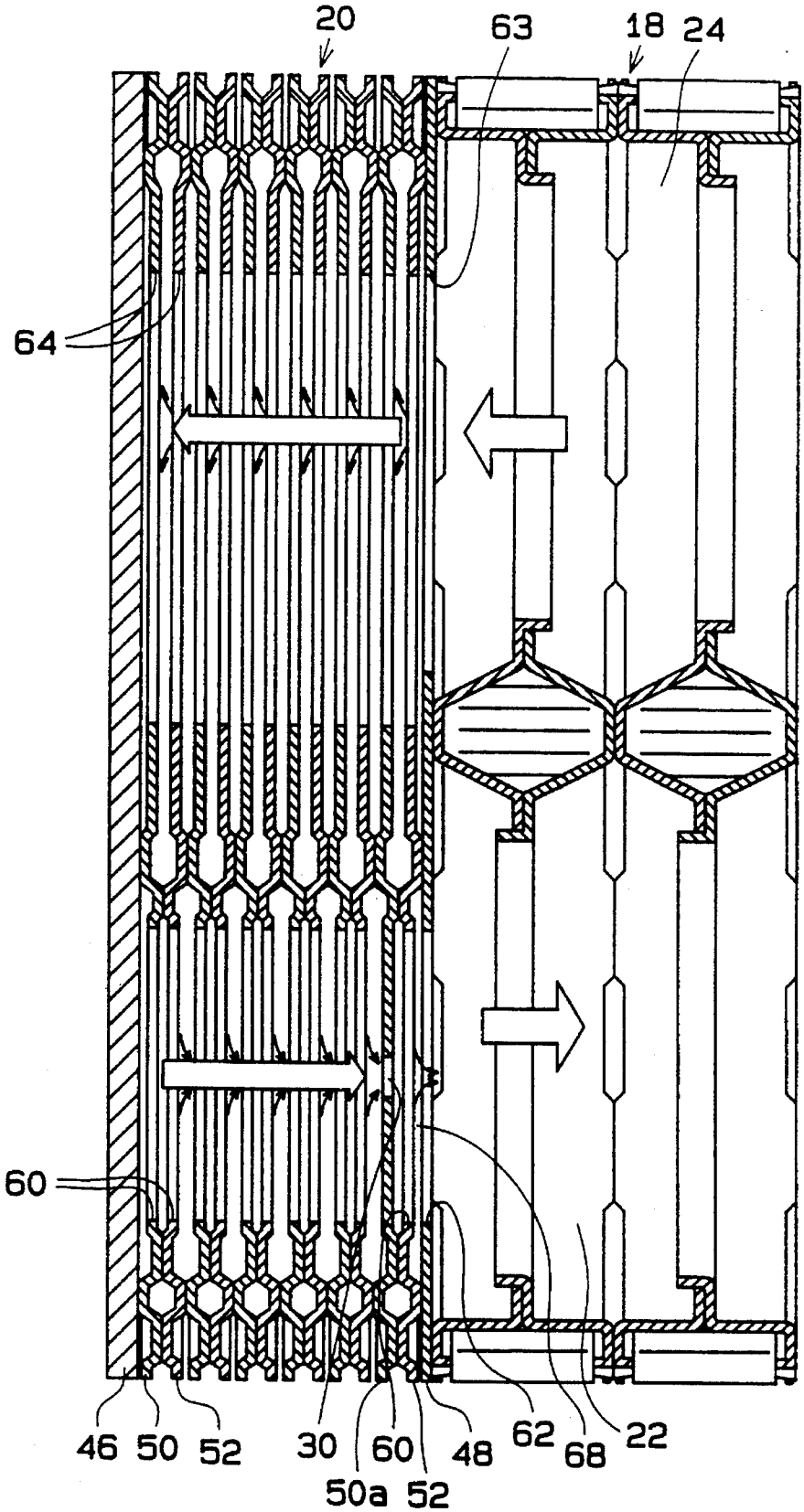
FIG. 9 is an expanded cross-sectional view taken along line IV—IV of FIG. 5.

Furthermore, as illustrated in FIG. 9, second connection ports 63 and 64 are formed at the lower part of the first and second plates 50 and 52 and the second side plate 48 so as to be linked with the outflow passage 24 of the evaporation part 18. These second connection parts 63 and 64 are also linked with the second passage 56. Moreover, as illustrated in FIG. 7, the second passage 56 is connected to outflow ports 66 in the upper part of the first and second plates 50 and 52 and the outlet port 34 in the first side plate 46.

The second connection ports 63 and 64, the second passage 56 and the outflow ports 66 form the cooling passage 32. Furthermore, the heat exchange part 20 is formed to allow heat exchange between the refrigerant flowing through the cooled passage 28 and the refrigerant flowing through the cooling package 32 through the first and second plates 50 and 52.

On the other hand, as illustrated in FIG. 7, the second throttle 40 composed of an orifice is formed at the one piece of first plate 50*a* instead of the inflow port 68. The second throttle 40 is linked with a third passage 68 formed between the second plate 52 and the second side plate 48 through the inflow port 58.

As illustrated in FIG. 9, the third passage 68 is linked with the first connection port 62 in the second side plate 48 and connected to the cooled passage 28. The inflow port 58 and the third passage 68 form the bypass passage 38.

Description will now be given to the operation of the evaporator for cooling units according to the above embodiment together with the operation of the refrigerating cycle.

Figure 12:
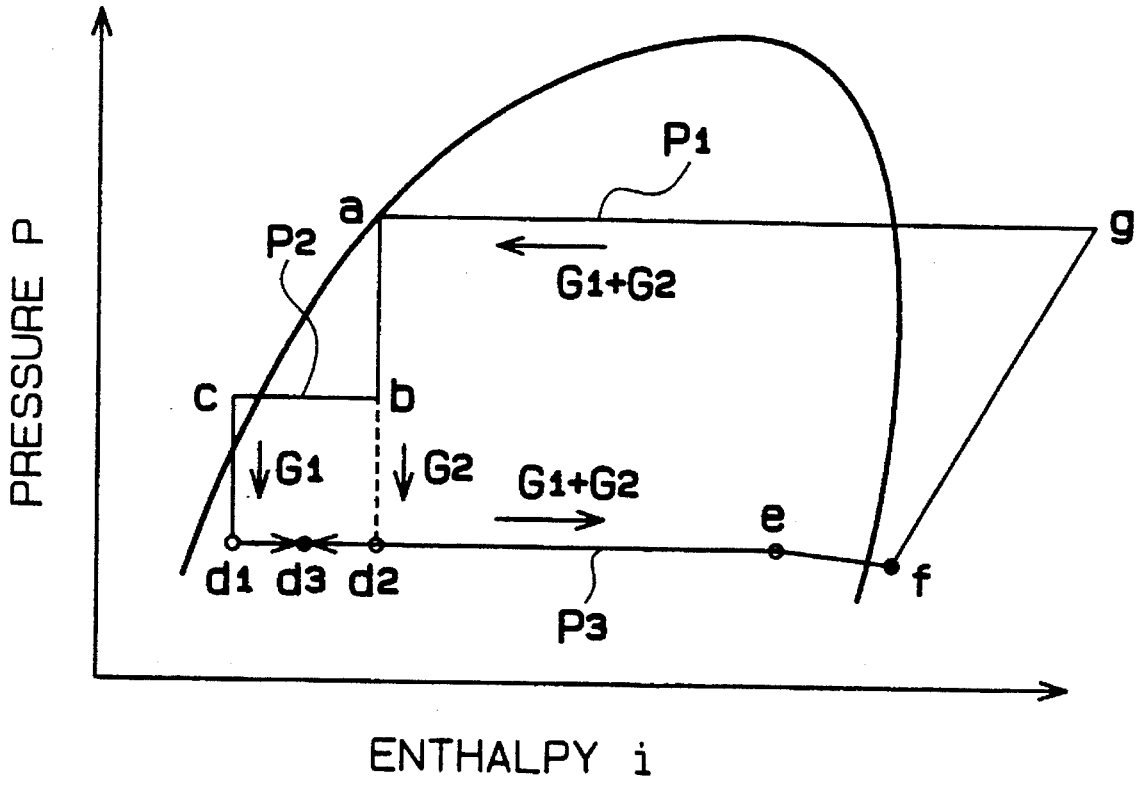
FIG. 12 is a graph illustrating a Mollier diagram of the first embodiment for the summer season.

The refrigerating cycle in the summer season will be described referring to FIG. 12 illustrating a Mollier diagram. The compressor 1 sucks and compresses a gaseous refrigerant (from Points f to Point g) and then feeds the refrigerant into the condenser 2. The condenser 2 makes heat exchange between the refrigerant and the six to cool the high-temperature refrigerant with the air for liquefaction (from Point g to Point a) and then feeds the liquid refrigerant into the receiver 4.

The refrigerant fed into the receiver 4 is temporarily stored there, and then fed into the expansion valve 6. The opening of the expansion valve 6 is adjusted by the balance among the pressure Pf of the thermo-sensing tube 8 detected through the capillary tube 14 in the downstream from the evaporator 16, the energizing force Ps of the spring 10, and the refrigerant pressure PO in the downstream from the evaporator 16 detected through the outer balancing pipe 17.

The refrigerant passed through the expansion valve 6 is adjusted in flow rate according to the opening thereof and at the same time reduced in pressure (from Point a to Point b), and then fed into the inlet port 57 of the evaporator 16. Part of the refrigerant, G1, flowed from the inlet port 57 into the inflow port 58 flows down through the first passage 54 to the first link port 60 (from Point b to Point c), and further flows from the cooled passage 28 to the inflow passage 22 of the evaporator 18 through the first throttle 30 (from Point c to Point d1).

Another part of the refrigerant, G2, which is branched according to the opening of the first throttle 30 and the opening of the second throttle 40 and fed into the inflow opening 58, is fed through the second throttle 40 (from Point b to Point d2) into the third passage 68 (bypass passage 39), then into the cooled passage 28 through the first connection port 62, and then into the inflow passage 22 of the evaporation part 18 (from Point d1 to Point d3 for the refrigerant G1 through the cooled passage 28, and from Point d2 to Point d3 for the refrigerant G2 through the bypass passage 38).

The refrigerant fed into the inflow passage 22 of the evaporation part 18 is fed through the inflow passage 22 and then branched into each refrigerant passage 26. When the refrigerant is within the refrigerant passages 26, heat exchange is made among the refrigerant G1+G2, and the air through each core plate 42 to cool the air to be supplied into the compartment (from Point d3 to Point e).

The refrigerant fed into the outflow passage 24 through the refrigerant passage 26 is fed into the second connection ports 63 and 64, and then fed from the second connection ports 63 and 64 into the second passage 56. Heat exchange is made between the refrigerant flowing through the second passage 56 (cooling passage 32) and the refrigerant flowing through the first passage 54 (cooled passage 28) to cool the refrigerant flowing through the first passage 54.

When the refrigerant passes through the second passage 56, the refrigerant is heated (from Point e to Point f) into a superheated refrigerant. On the other hand, the refrigerant G1 within the first passage 54 is cooled (from Point b to Point c), and the refrigerant, which is in the gas-liquid two phase state, is turned to be a liquid refrigerant.

In the above arrangement, the liquefaction of the refrigerant flowing through the first passage 54 is promoted. As a result, the refrigerant is turned to be a refrigerant in the single liquid state, and fed into the inflow passage 22 of the evaporation part 18. At this time, the refrigerant is evenly distributed to each refrigerant passage 26 to protect the air flowing between each core plate 42 from uneven cooling. In other words, as the refrigerant is in the almost single liquid state, the refrigerant can be distributed almost evenly from the inflow passage 22 to each refrigerant passage 26 without providing any throttle valve or the like for even distribution. The refrigerant fed from the second passage 56 to the outlet port 34 is further fed from the exhaust passage 36 to the compressor 1.

In the above embodiment, when the pressure of the condenser 2, P1, is equal to 1 MPa an the pressure of the evaporation part 18, P3, is equal to 0.3 MPa, for example, the pressure of the cooled passage 28, P2, is equal to 0.6 MPa. When the first throttle 30 and the second throttle 40 are supposed to be the same in throttle diameter (2.6 mm), and the dryness fraction x at each point illustrated in FIG. 12 is provisionally calculated, the following results can be obtained: xa=0 at Point a immediately before the inflow into the expansion valve 6, xb=0.3 at Point b at the outlet side of the expansion valve 6, and xc=0 at Point c immediately before the inflow into the first throttle 30 (degree of supercooling: 5° C.); xd1=0.05 at Point d1 after the outflow from the thirst throttle 30, xd2=0.25 at Point d2 after the outflow from the second throttle 40, and xd3=0.11 at Point d3 at the inlet side of the inflow passage 22 after the confluence.

Figure 10:
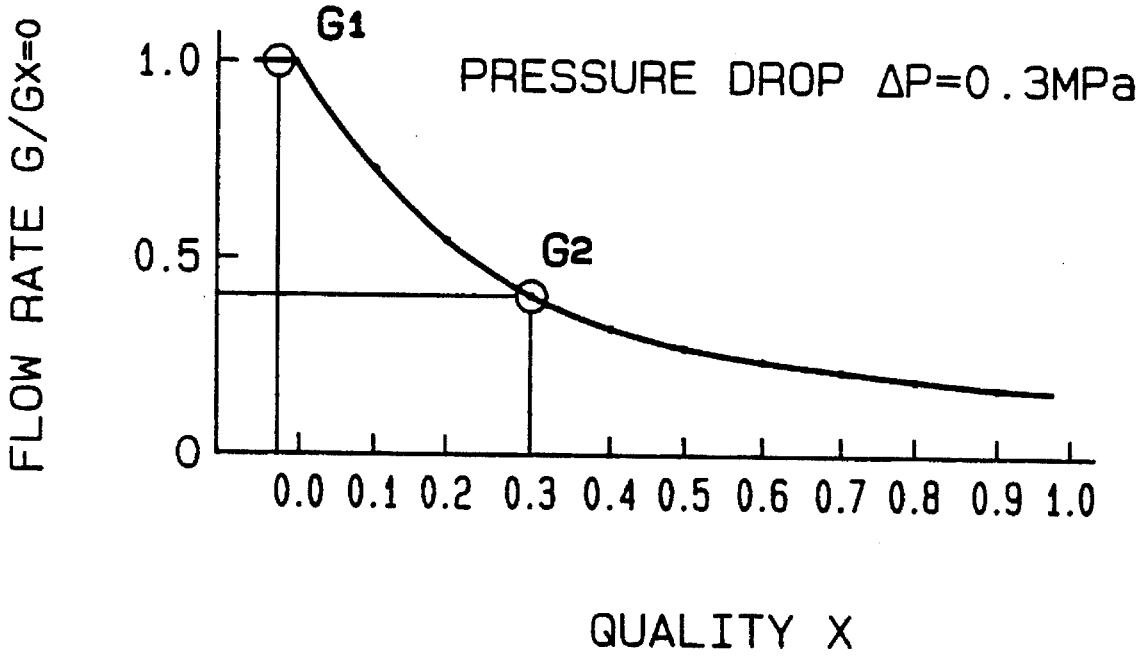
FIG. 10 is a graph illustrating the flow rate of the refrigerant in a first throttle and a second throttle of the first embodiment in the summer season.
Figure 11:
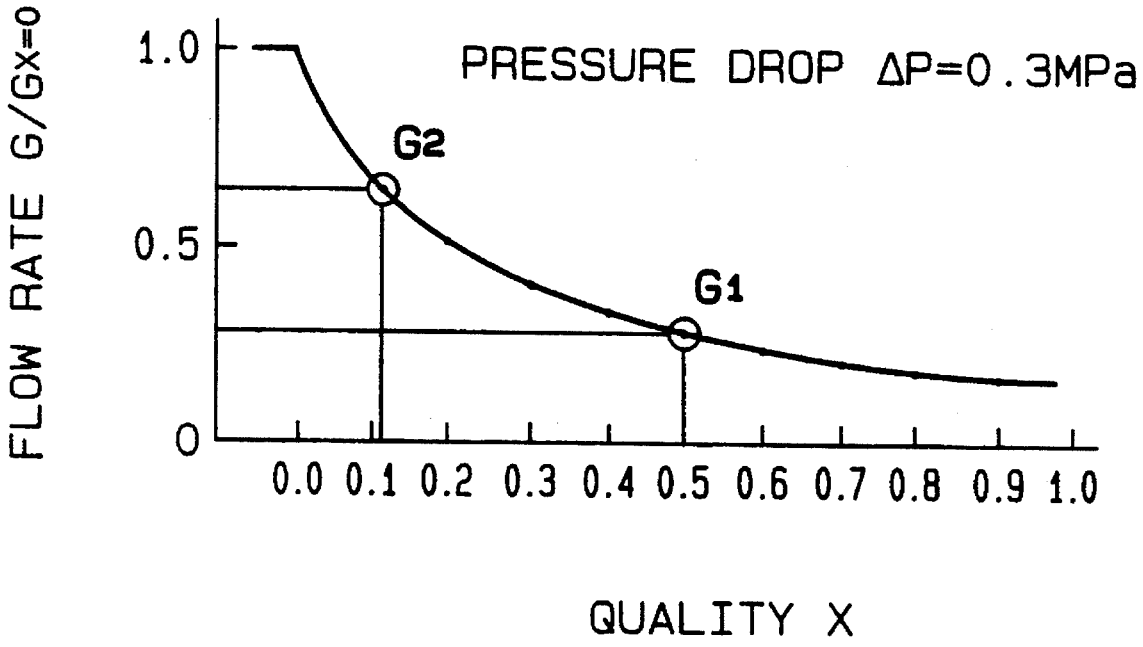
FIG. 11 is a graph illustrating the flow rate of the refrigerant in the first throttle and second throttle of the first embodiment in the winter season.

Furthermore, in this embodiment, when the pressure difference before the first throttle 30 and after the second throttle 40, ΔP is 0.3 MPa, the flow rate is as illustrated in FIGS. 10 and 11. As the refrigerant G1 flowing through the cooled passage 28 is cooled by the cooling passage 32, the dryness fraction xc is equal to 0 (degree of supercooling: 5° C.), and the ratio of the flow rate is weight of this refrigerant G1 to that of the refrigerant with a dryness fraction x of 0 is 1.0. On the other hand, the refrigerant G2 flowing through the bypass passage 38 is the same in the dryness fraction xb as that of the outlet side of the expansion valve 6, which is equal to 0.3. The ratio of the flow rate in weight of this refrigerant G2 to the refrigerant with a dryness fraction x of 0 is approximately 0.4 Namely, in two flows of refrigerant, if there is no pressure difference before and after the throttles, the refrigerant with the higher dryness fraction x will reduce weight to pass through the throttle.

As the refrigerant G1 flowing through the cooled passage 28 is small in the dryness fraction x due to cooling, the refrigerant G1 can flow therethrough more easily than flowing through the bypass passage 38. Therefore, as the refrigerant flows through the cooled passage 28 and through the bypass passage 38 at a ratio of 1.0:0.4 approximately 70% of the refrigerant (weight %, the hereinafter % means weight %) through the cooled passage 28. When the dryness fraction of the refrigerant flowing into the inflow passage 22, xd3, is, as described in the above, equal to 0.11.

As described in the above, the dryness fraction of the refrigerant flowing into the inflow passage 22, x, can be controlled to be small, and the refrigerant can be distributed almost evenly to each refrigerant passage 34. This dryness fraction x should preferably be controlled to be 0.2 or less. When the dryness fraction x is 0.2 or less, almost even distribution can be achieved.

Incidentally, the opening of the expansion valve 6 is adjusted so that the refrigerant temperature and refrigerant pressure PO in the downstream from the evaporator 16 can be detected and the refrigerant pressure and refrigerant temperature at Point f in the downstream from the evaporator 16 can be compensated. Therefore, even if the first throttle 30 and the second throttle 40 are provided within the evaporator 16, the opening of the expansion valve 6 can be adjusted. As a result, in the expansion valve 6, pressure is reduced between Point a and Point b, in the first throttle 30, pressure is reduced between Point c and Point d1, and in the second throttle 40, pressure is reduced from Point b to Point d2.

In the refrigerating cycle in which the pressure and temperature of the refrigerant in the downstream from the evaporator 16 are detected and the expansion valve 6 whose opening an be adjusted is used as described in the above, the already installed evaporator can be replaced by the evaporator 16 of this embodiment, and after such replacement, the above refrigerating cycle can be performed in the same way.

Figure 13:
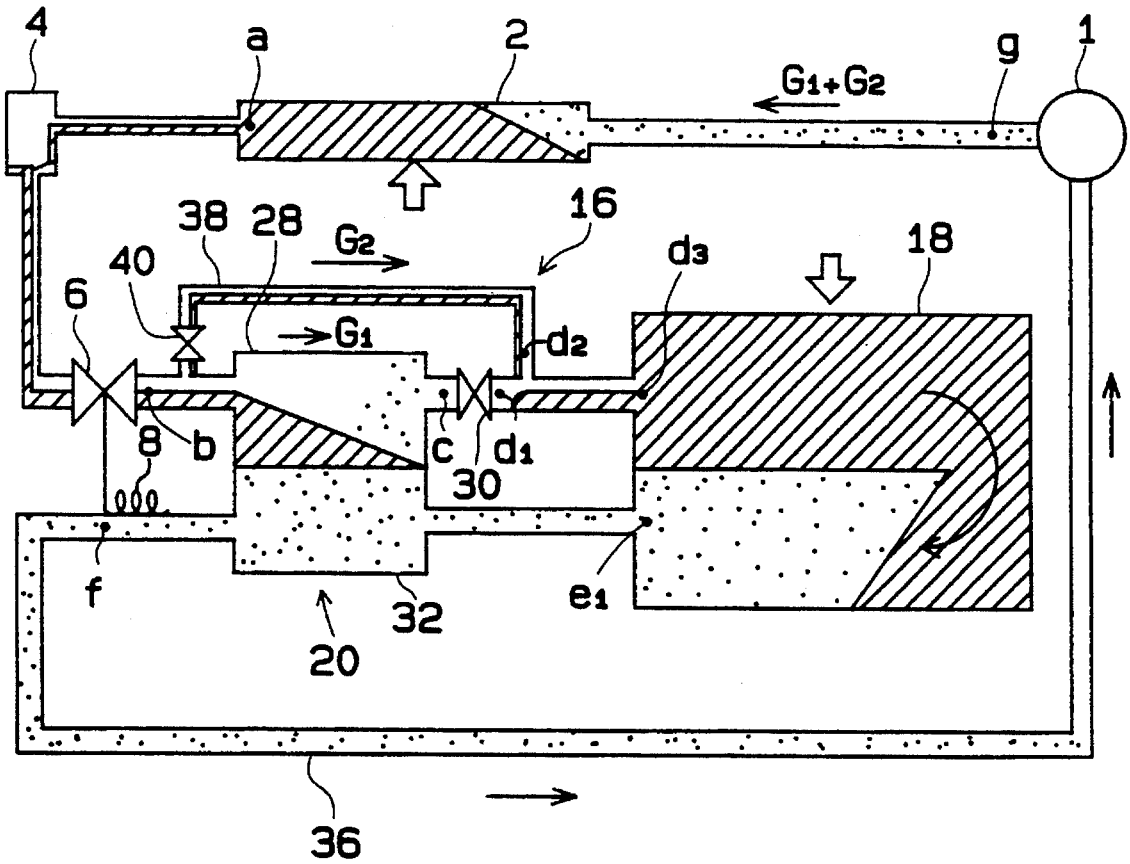
FIG. 13 is a schematic structural view of a refrigerating cycle to which the evaporator for cooling units of the first embodiment is applied illustrating the low volume of the refrigerant in the winter season.

On the other hand, in the air conditioning for recent vehicles, even in the winter season, the refrigerating cycle is performed, and after the air is dehumidified and then heated by a heater (not illustrated). When the temperature of the air flowing through the condenser 2 is as low as 0° to 10° C. as it is in the winter, as illustrated in a schematic structural view of FIG. 13 and a Mollier diagram of FIG. 14, the refrigerant compressed by the compressor 1 (from Point f to Point g) is fed into the condenser 2, subjected to heat exchange there, and cooled into a liquid refrigerant (from Point g to Point a). However, in the condenser 2, as the ambient temperature is low, the liquefaction of the refrigerant is promoted, and the refrigerant tends to stay there, and, at the same time, the pressure at the outlet of the condenser 2 falls.

The liquid refrigerant flows through the receiver 4, is subjected to pressure reduction by the expansion valve 6 (from Point a to Point b), and then is fed into the cooled passage 28. Then, the refrigerant is fed into the inflow passage 22 of the evaporation part 18 through the first throttle 30 (from Point c to Point d1).

At this time, the refrigerant in supply is low in pressure and small in volume. The refrigerant fed into the inflow passage 22 is then distributed to each refrigerant passage 26 for heat exchange with the air. The temperature of the air heated by the heater (not illustrated) is so high, 25° C., for example, that the refrigerant is turned into a superheated vapor and fed into the outflow passage 24.

The refrigerant is then fed from the outflow passage 24 into the cooling passage 32 of the heat exchange part 20 for heat exchange with the refrigerant in the cooled passage 28. In this heat exchange, as the temperature of the refrigerant in the cooling passage 32 is higher, the refrigerant in the cooled passage 28 is heated (from Point b to Point c) while the refrigerant in the cooling passage 32 is cooled (from Point e to Point f).

When the refrigerant in the cooled passage 28 is heated, the evaporation of the refrigerant is promoted to such an extent that it is difficult for the refrigerant to smoothly flow through the cooled passage 28. Incidentally, as the refrigerant in the cooling passage 32 is cooled, the refrigerant temperature detected by the thermo-sensing tube 8 falls enough to reduce the opening of the expansion valve 6 and resultantly reduce the flow rate.

For this reason, a large part of the refrigerant flowed through the expansion valve 6 flows into the bypass passage 38, and joins the refrigerant in the cooled passage 28 disposed in the downstream from the first throttle 30, and then flows into the inflow passage 22 of the evaporation part 18.

The refrigerant G2 flowing through the bypass passage 38 is in the liquid state with a dryness fraction of nearly 0 and is large in volume besides. Therefore, even when the refrigerant G2 joining the refrigerant G1 flowing out of the cooled passage 28, the refrigerant with a low dryness fraction x is fed into the inflow passage 22, and then distributed almost evenly to each refrigerant passage 26.

Now, it is supposed that the pressure of the condenser 2, P1, is 0.4 MPa, the pressure of the cooled passage 28, P2, is 0.35 MPa, the pressure of the evaporation part 18, P3, is 0.3 MPa, and the dryness fraction at Point a immediately before the inflow into the expansion valve 6, xa, is 0.1.

Figure 14:
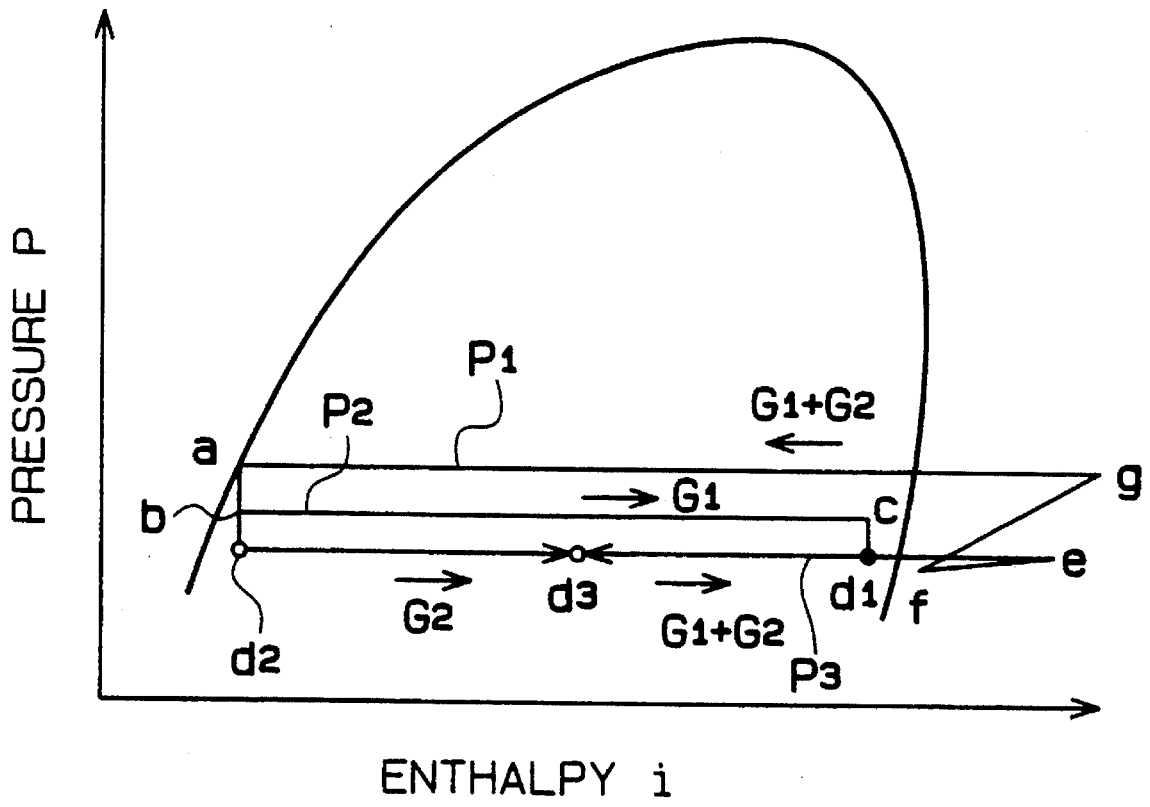
FIG. 14 is a graph illustrating a Mollier diagram of the first embodiment in the winter season.

When the dryness fraction x at each point is provisionally calculated, the following results can be obtained: xb=0.11 at Point b at the outlet side of the expansion valve 6, xc=0.5 at Point c immediately before the inflow into the first throttle 30, xd1=0.51 at Point d1 immediately after the outflow from the first throttle 30, and xd2=0.15 at Point d2 immediately after the outflow from the second throttle 40 as illustrated in FIG. 14.

On the other hand, as illustrated in FIG. 11, as the refrigerant G1 flowing through the cooled passage 28 is heated, the dryness fraction thereof, xc, is 0.5. Therefore, the ratio of the flow rate in weight of the refrigeration G1 to that of the refrigerant with a dryness fraction x of 0 is approximately 0.3. Furthermore, as the refrigerant G2 flowing through the bypass passage 38 has the same dryness fraction xb of 0.11 as that at the outlet side of the expansion valve 6, and the ratio of the flow rate in weight of this refrigerant G2 to the refrigerant with a dryness fraction x of 0 is approximately 0.6.

The refrigerant G1 flowing through the cooled passage 28 is heated, and, as a result, the dryness fraction thereof, x, increases. Therefore, it is different for the refrigerant G1 to smoothly flow through the cooled passage 28 compared with flowing through the bypass passage 28. As the refrigerant flows through the cooled passage 28 and through the bypass passage 38 at a ratio of 0.3:0.7, approximately 30% of the refrigerant flows through the cooled passage 28 and approximately 70% of the refrigerant flows through the bypass passage 38. Furthermore, the refrigerant from the cooled passage 28 and the refrigerant from the bypass passage 38 join, and the combined refrigerant flowing through the bypass passage 38 is low in dryness fraction and is large in volume. For this reason, the dryness fraction of the refrigerant flowing into the inflow passage 22, x, can be controlled to a low level, and therefore, the refrigerant can be distributed almost evenly to each refrigerant passage 34.

The second embodiment which is different from the above embodiment will now be described referring to FIG. 15. In giving description, however, the same components as those of the above embodiment will be denoted by the same reference numerals, and the details thereof, being regarded to be the same as those in the above embodiment, will be omitted. This way of brief description will also be applied to the description of the third through seventh embodiments herein lator.

In the second embodiment, the bypass passage 38 is branched from between a receiver 4 and an expansion valve 6. In this arrangement as well, as is the case with the operation in the winter season as described in the above, the refrigerant flowing through a cooled passage 28 is heated by the refrigerant flowing through a cooling passage 32. As a result, the volume of the refrigerant increases, the opening of the expansion valve 6 decreases, and the volume of the refrigerant flowing through the cooled passage 28 decreases. Even in this case, as the liquid refrigerant in the upstream from the expansion valve 6 is fed into an evaporation part 18 through a second throttle 40 and the bypass passage 38 so that the refrigerant can be distributed almost evenly to each refrigerant passage 34 without causing any degradation in cooling performance.

Next, the third embodiment will be described with reference to FIGS. 16 through 19.

Figure 17:
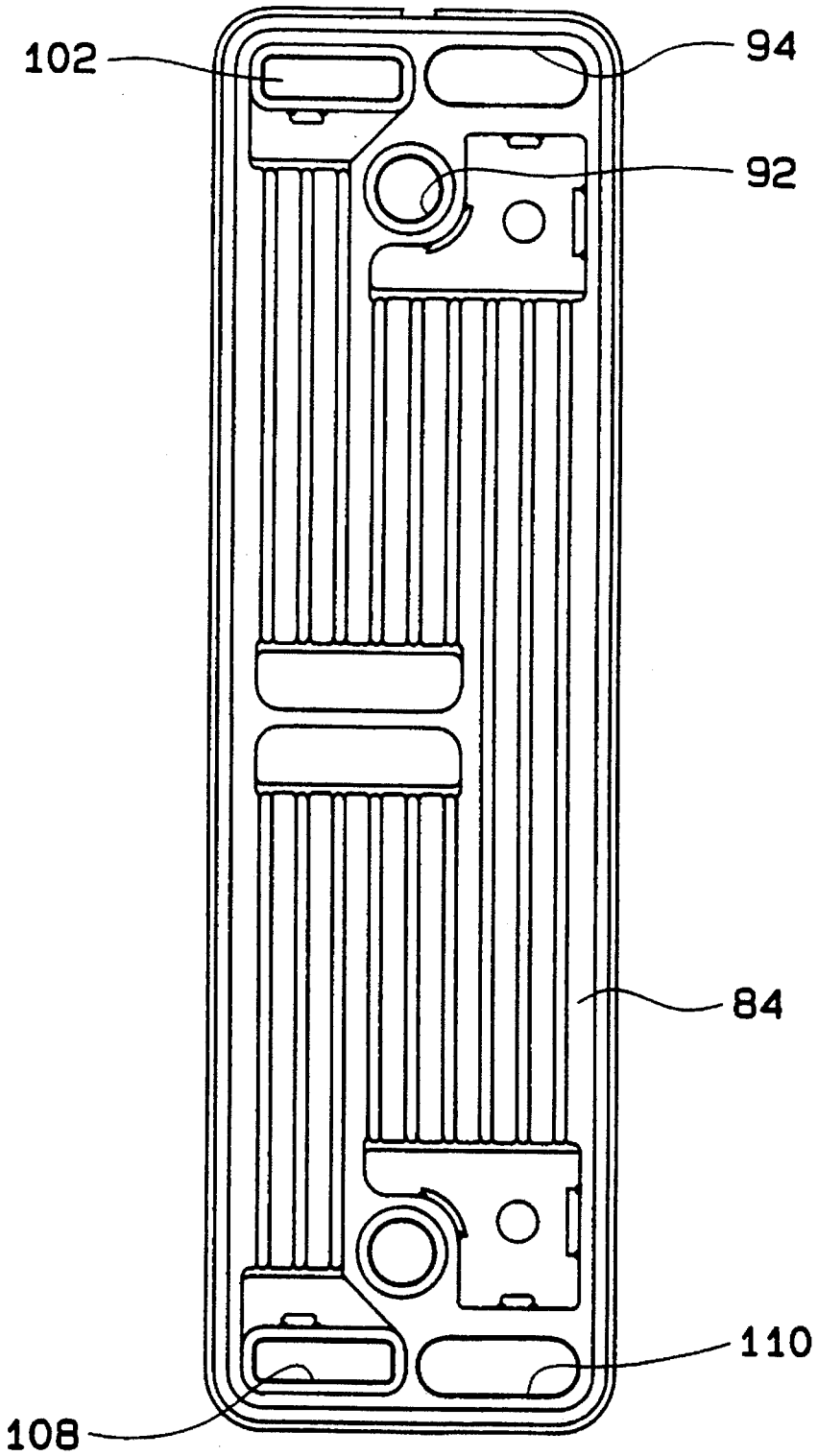
FIG. 17 is an expanded front view of a first plate of the third embodiment.

A plurality pairs of first and second plates 84 and 86 are alternatively stacked between first and second side plates 80 and 82. A pair of first and second plates 84 and 86 are symmetrical. An inlet port 88 and an outlet port 90 are formed at the upper port of the first side plate 80, and, as illustrated in FIG. 17, an inflow port 92 and an outflow port 94 are formed at the upper part of the first plate 84 in correspondence to the inlet port 88 and the outlet port 90 respectively. The second plate 86 is also arranged in the same way.

Figure 18:
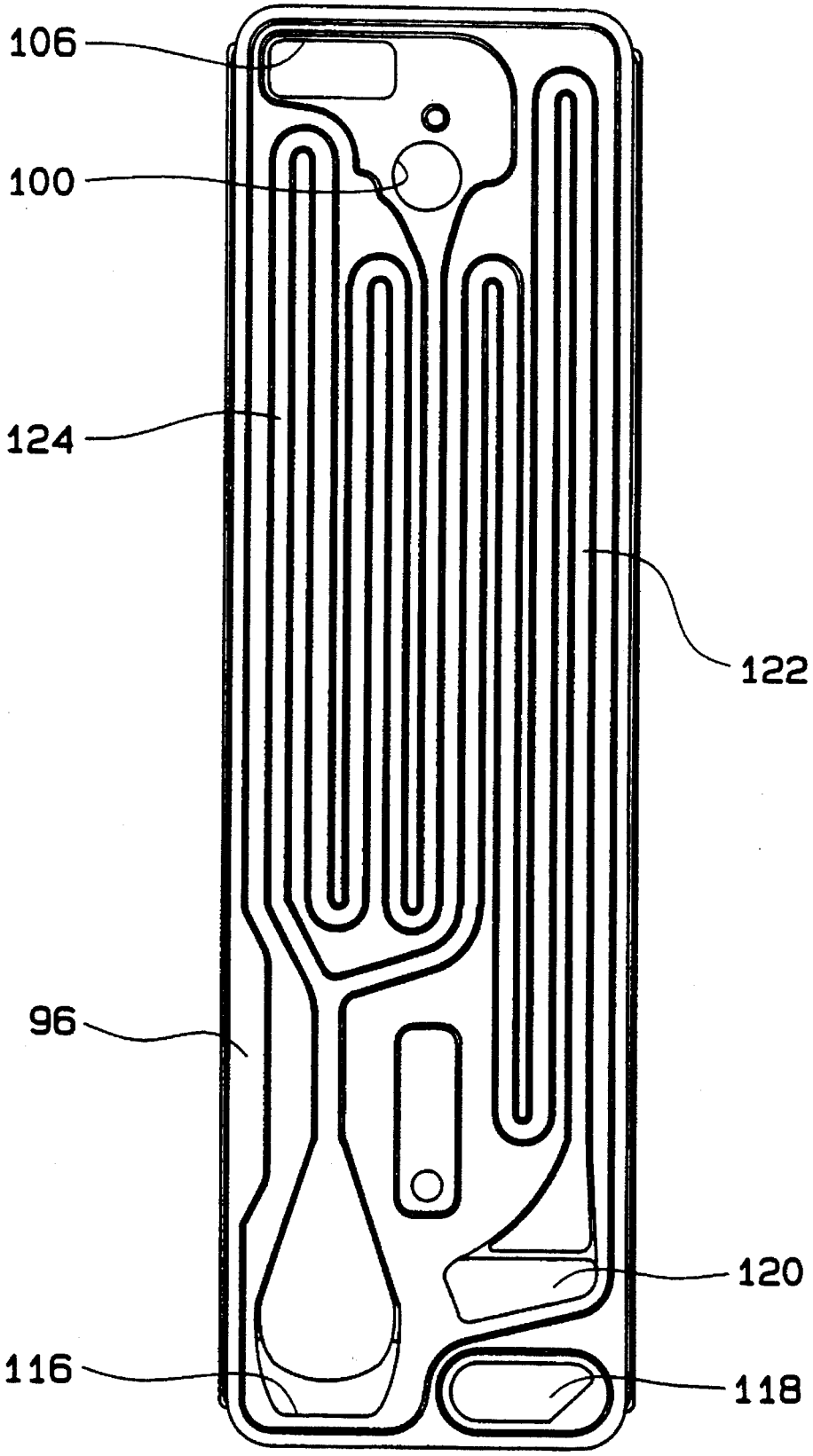
FIG. 18 is an expanded front view of a capillary plate of the third embodiment.

A capillary plate 96 and a partition plate 98 are stacked on the second side plate 82. As illustrated in FIG. 18, a through port 100 is formed at the upper part of the capillary plate 96 in correspondence to the inflow port 92. Link ports 102, 104 and 106 are formed at the upper part of the first and second plates 84 and 86, second side plate 82 and capillary plate 96, and the through port 100 and link port 106 of the capillary plate 96 are linked with each other through a passage 103 formed between the capillary plate 96 and the partition plate 98.

As illustrated in FIG. 17, a supply port 108 and a connection port 110 are formed at the lower part of the first plate 84, and the second plate 86 is also arranged in the same way. The first and second plates 84 and 86 have a numerosity of convex parts and concave parts, and alternatively stacked to form a numerosity of first passages 112 between the insides of the first plates 84 and the insides of the second plates 86 to ink the link port 102 and the supply port 108. In the same way, a numerosity of second passages 114 are formed between the outsides of the first plates 84 and the outsides of the second plates 86 to link the outflow port 94 and the connection port 110.

First and second connection ports 116 and 118 are formed at the lower part of the capillary plate 96. The second connection port 118 is linked with the connection port 110 at the first and second plates 84 and 86 through a port (not illustrated).

A through port 120 is formed at the capillary plate 96 so as to be linked with the supply port 108 in the first and second plates 84 and 86 through a through port formed at the second side plate 82 (not illustrated). This link port 120 and the connection port 116 are linked with each other through a first capillary passage 122 which are formed between the capillary plate 96 and the partition plate 98 by denting the capillary plate 96. The through port 100 and the first connection port 116 are linked with each other through a second capillary passage 124 which are formed between the capillary plate 96 and the partition plate 98 by denting the capillary plate 96.

Figure 19:
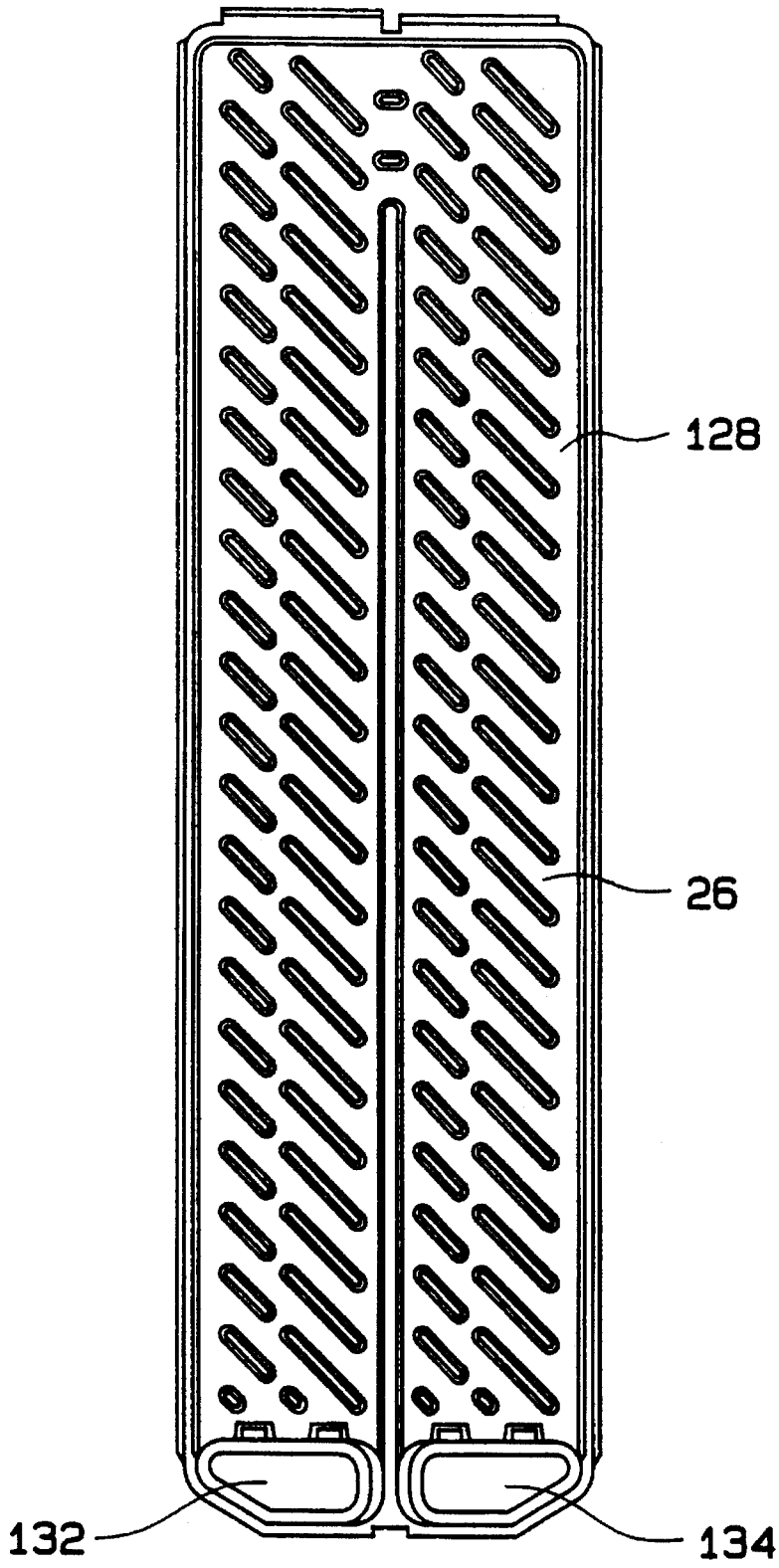
FIG. 19 is an expanded front view of a core plate of the third embodiment.

Furthermore, a plurality of core plates 128 and 130 are alternatively stacked between the partition plate 98 and a third side plate 126 with fins therebetween to finalize an evaporation part 18. As illustrated in FIG. 19, an inflow port 132 and an outflow port 134 are formed at the lower part of the core plate 128, and the core plates 128 and 130 are symmetrical. These inflow ports 132 form an inflow passage 22, while the outflow ports 134 formed an outflow passage 24.

A reverse U shape refrigerant passage 26 is formed between the core plates 128 and 130 to link the inflow port 132 and the outflow port 134. The inflow port 132 is formed in correspondence to the first connection port 116, while the outflow port 134 is formed in correspondence to the second connection port 118.

A cooled passage 28 is formed by the inflow ports 92, the through ports 100, the passage 103, the link ports 106, the link ports 102, the first passages 112, the supply ports 108, the ink ports 120 and the first connection port 116. On the other hand, a cooling passage 32 is formed by the connection ports 110, the second connection ports 118, the second passages 114 and the outflow ports 94. The first capillary passage 122 serves as the first throttle and the second capillary passage 124 as the second throttle.

In the above embodiments, the first and second throttles are composed of orifices. In addition to this arrangement, the first and second capillary passages 122 and 124, which may constitute thin passages with the specified small cross sections, may be used for composing the first and second throttles and enforceable as much as those of the above embodiments.

Now, the fourth embodiment will be described referring to FIGS. 20 to 24.

Figure 20:
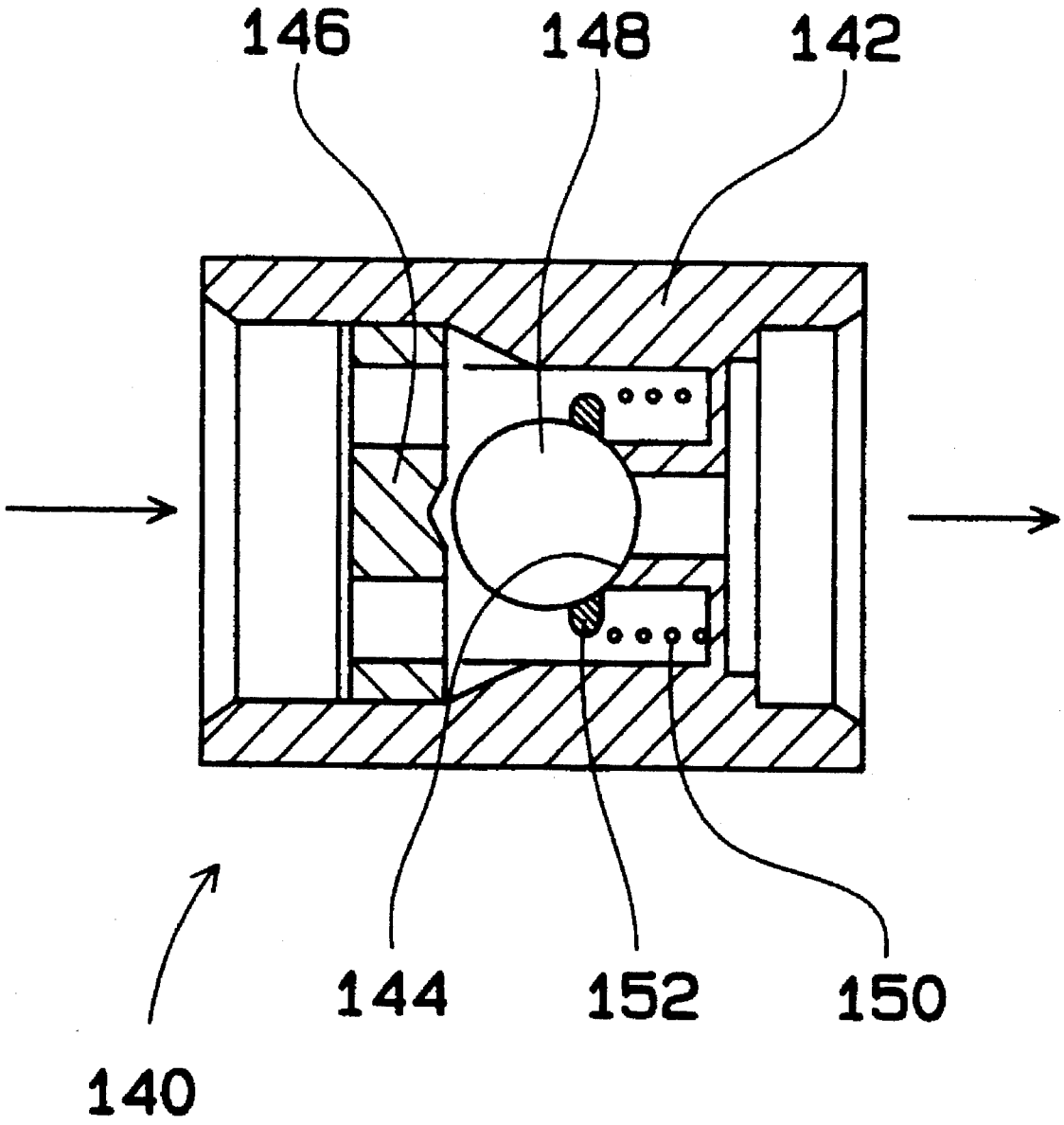
FIG. 20 is an expanded cross-sectional view of a switch valve of the fourth embodiment.

In the fourth embodiment, a switch valve 140 illustrated in FIG. 20 is set in a bypass passage 38. The switch valve 140 includes a ball valve 148 which can move between a valve seat 144 formed within a valve element 142 and a stopper 146 set in the valve element 142. The valve seat 144 works as a second throttle. The ball valve 148 is energized in a direction in which the ball valve 148 separates from the valve seat 144 by the energizing force of a spring 150 set in the valve element 142.

The switch valve 140 is structured as follows: when the difference in the pressure in the upstream from the ball valve 148 and the pressure in the downstream from the ball valve 148 becomes the preset amount or more (e.g. 0.25 MPa or more), the ball valve 148 seats the valve seat 144 against the energizing force of the spring 150 to close the valve and shut off a bypass passage 38; when said pressure difference becomes the preset amount or less (e.g., 0.2 MPa or less), the ball valve 148 separates from the valve seat 144 by the energizing force of the spring 150 to open the valve and link the bypass passage 38.

Figure 21:
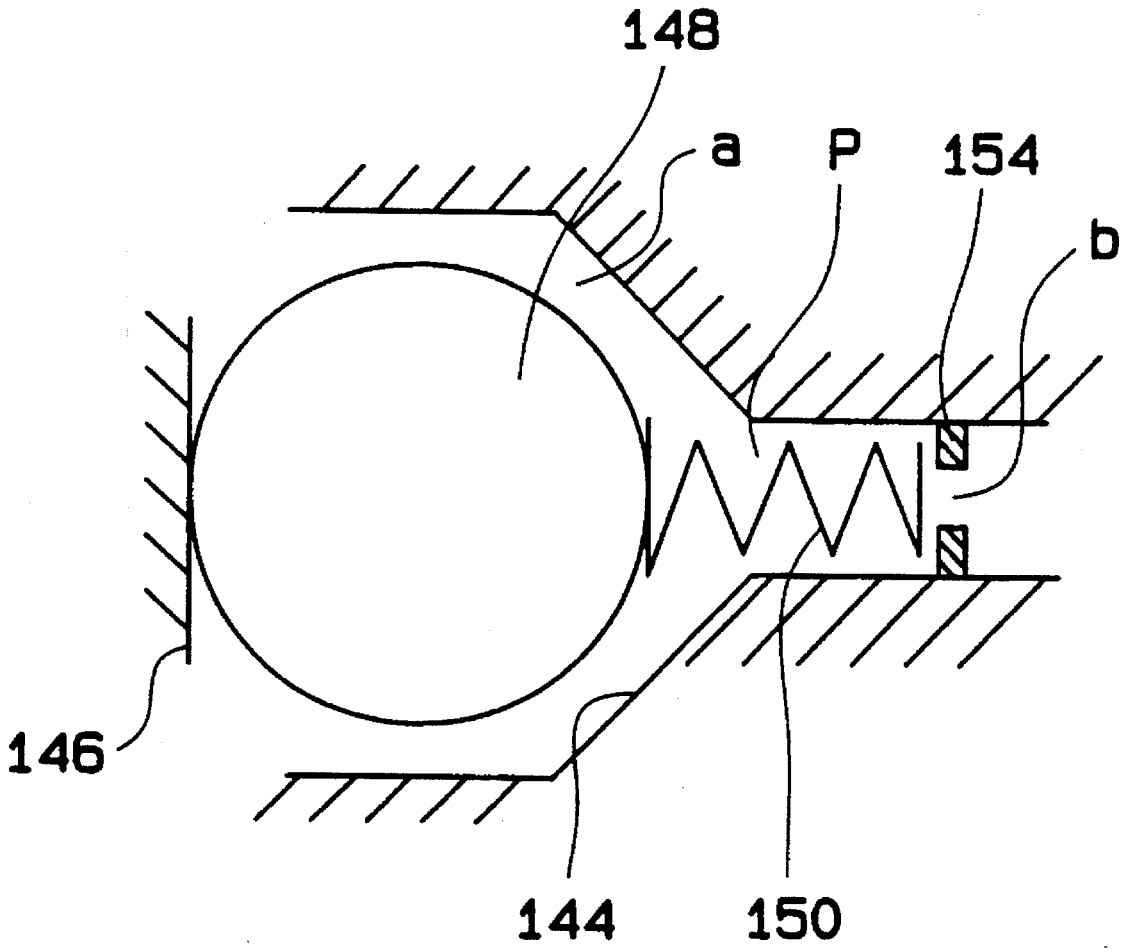
FIG. 21 is an illustrative view illustrating the open state of the switch valve of the fourth embodiment.

As illustrated in FIG. 21, the switch valve 140 may also be structured so that the valve seat 144 is tapered and an orifice 154 is formed in the downstream. Furthermore, the switch valve 140 may also be structured so that when the valve is in the open position, the open area between the ball valve 148 and valve seat 144, a, and the open area of the orifice 154, b, are equivalent to each other and the intermediate pressure behind the ball valve 148, P, is between the pressure upstream, PH, and the pressure in the downstream, PL.

Figure 22:
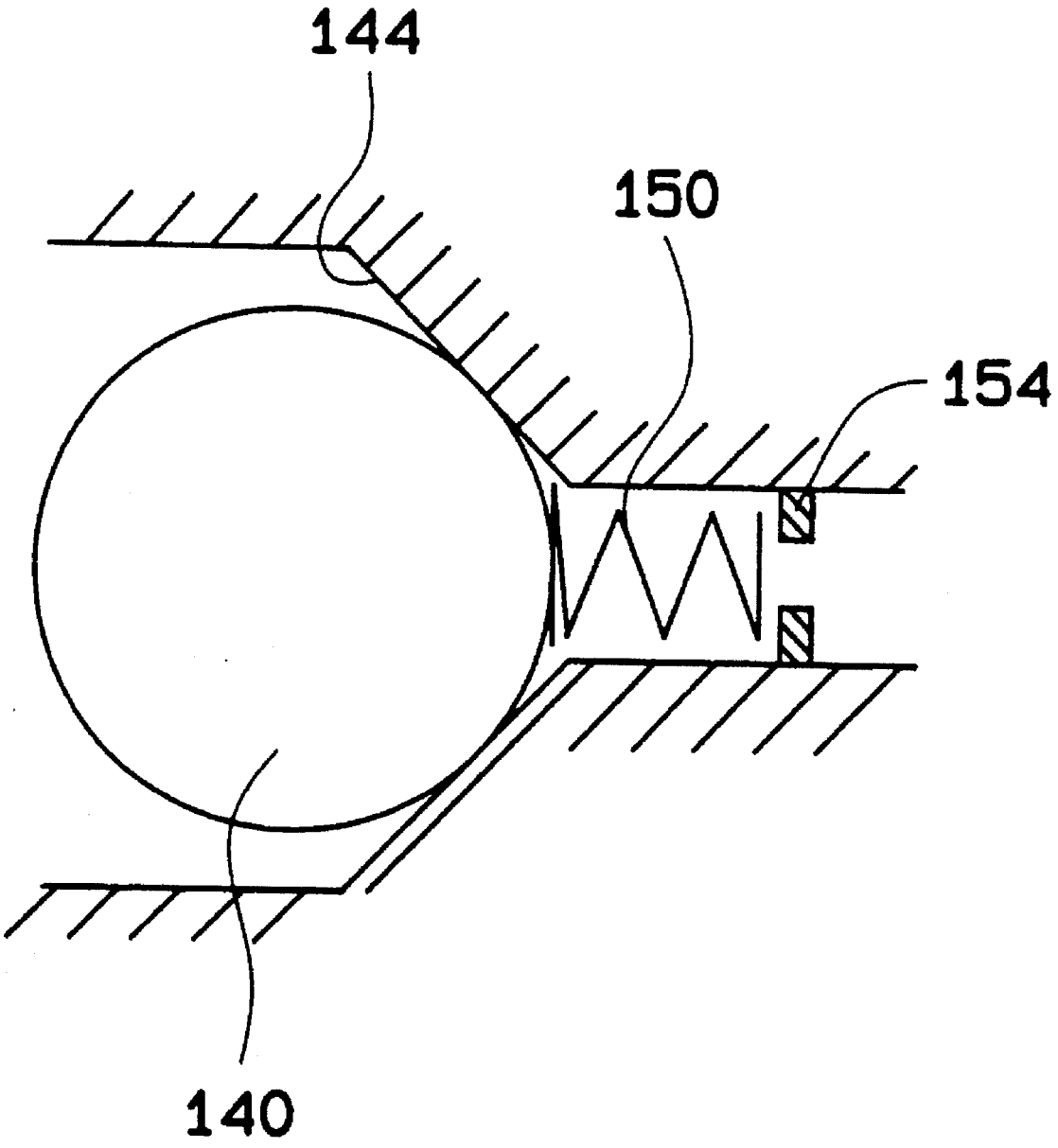
FIG. 22 is an illustrative view illustrating the closed state of the switch valve of the fourth embodiment.
Figure 23:
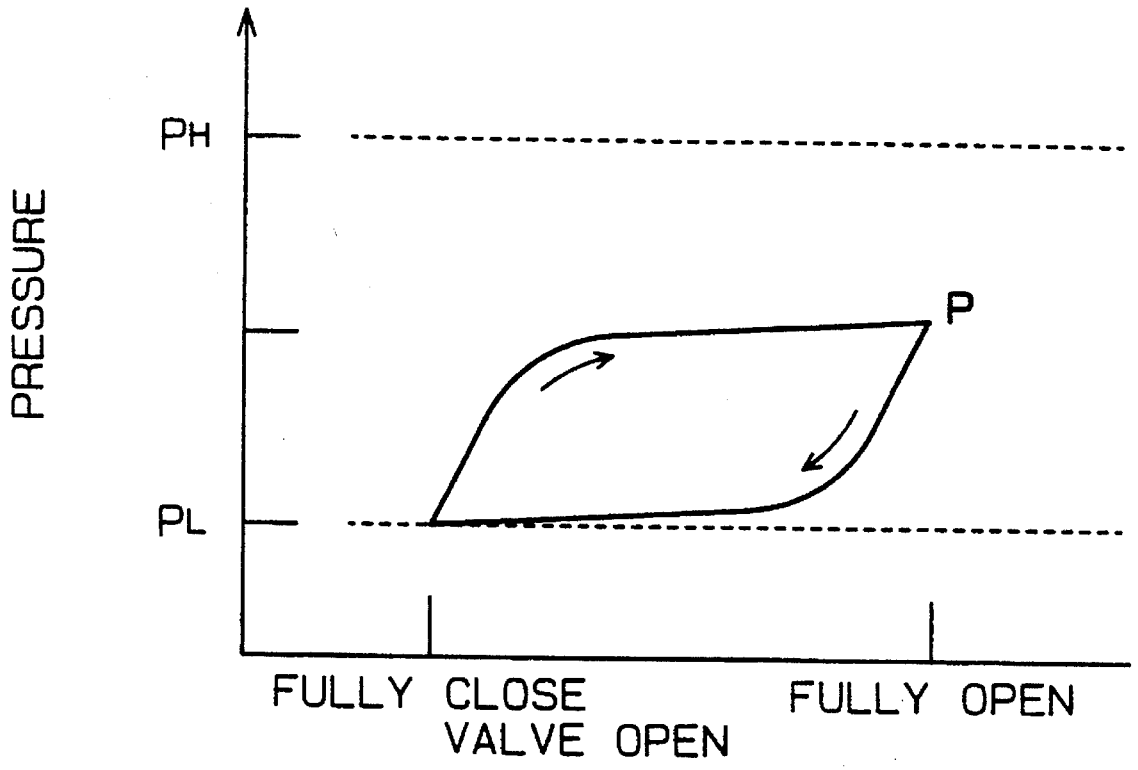
FIG. 23 is a graph illustrating the relation between the opening and pressure of the switch valve of the fourth embodiment.

In the above arrangement, when the valve is in the close position and the ball valve 148 moves to the valve closing direction, the open area a between the ball valve 148 and the valve seat 144 decreases, and the intermediate pressure P approaches the pressure PL in the downstream, and, as a result, the working force in the valve closing direction increases so much that the valve rapidly opens. Also, as illustrated in FIG. 22, when the valve is in the open position and the ball valve 148 moves in the valve open direction, the intermediate pressure P rapidly increases, and, as a result, the ball valve 148 is separated from the valve seat 144 by the energizing force of the spring 150 so much that the valve rapidly opens. As illustrated in FIG. 23, this arrangement allows rapid reaction even to a small pressure change without losing the stable condition.

When this switch valve 140 is provided and when cooling load is in a range of medium to high in the summer season or the like, pressure difference in the bypass passage 38 between the upstream and downstream 38 is large. In this case, the refrigerant should be fed only into the cooled passage 28 by closing the switch valve 140. By this arrangement, the liquid refrigerant with gas mixed therein is not fed into the bypass 38, whereby the cooling performance can be optimized.

When cooling load is small in the winter season or the like, pressure difference in the bypass passage 38 between the upstream and downstream is small. In this case, the liquid refrigerant should be fed into the evaporation part 18 through the bypass passage 38 to secure the necessary flow rate of the refrigerant.

Figure 15:
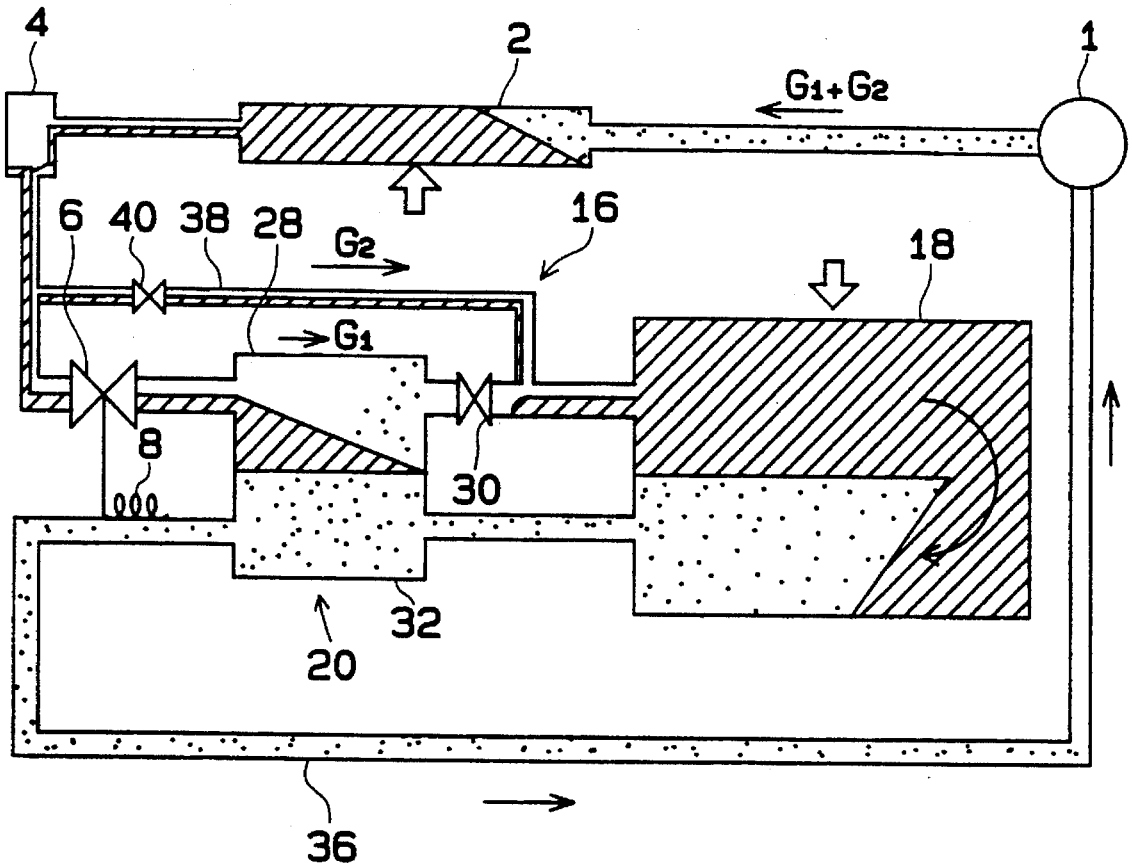
FIG. 15 is a schematic structural view of a refrigerating cycle to which an evaporator for cooling units of the second embodiment is applied illustrating the low volume of the refrigerant in the winter season.

The switch valve 140 is also applicable to the first embodiment illustrated in FIG. 1 in which the bypass passage 38 in FIG. 1 is branched in the downstream from the expansion valve 6, and to the second embodiment illustrated in FIG. 15 in which the bypass passage 38 is branched in the upstream from the expansion valve 6.

Figure 24:
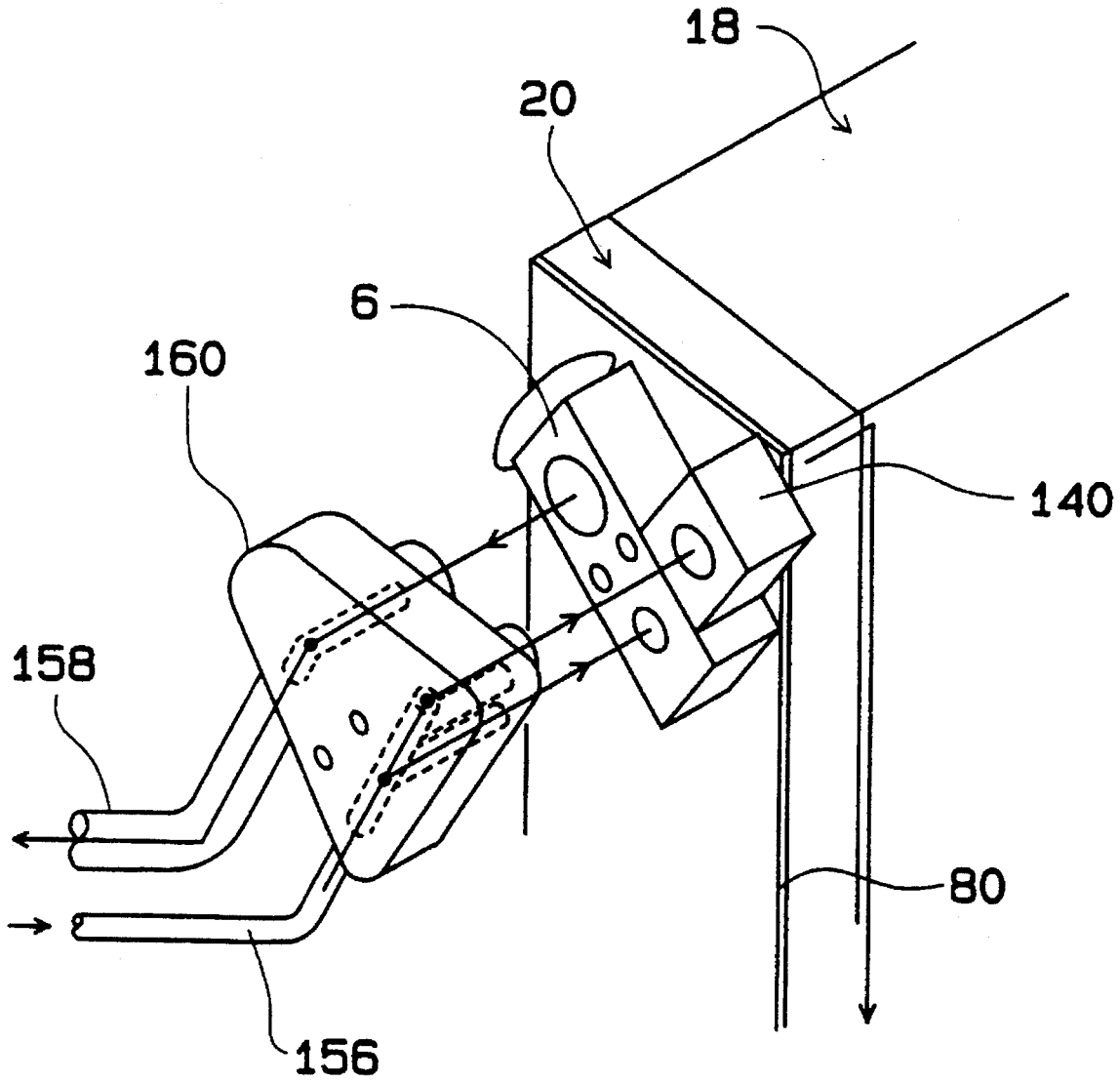
FIG. 24 is a schematic perspective view illustrating the mounted state of the switch valve of the fourth embodiment.

Incidentally, in the second embodiment illustrated in FIG. 15, the expansion valve 6 is attached to the first side plate 80 and the switch valve 140 is integrally attached to the expansion valve 6 on one hand, and a block joint 160 connection pipes 156 and 158 connected thereto is attached to a side of the expansion valve 6 on the other hand, both of which are is illustrated in FIG. 24. This arrangement facilitates the attachment of the switch valve 140, and, at the same time, saves space required for the attachment of the switch valve 140.

Figure 25:
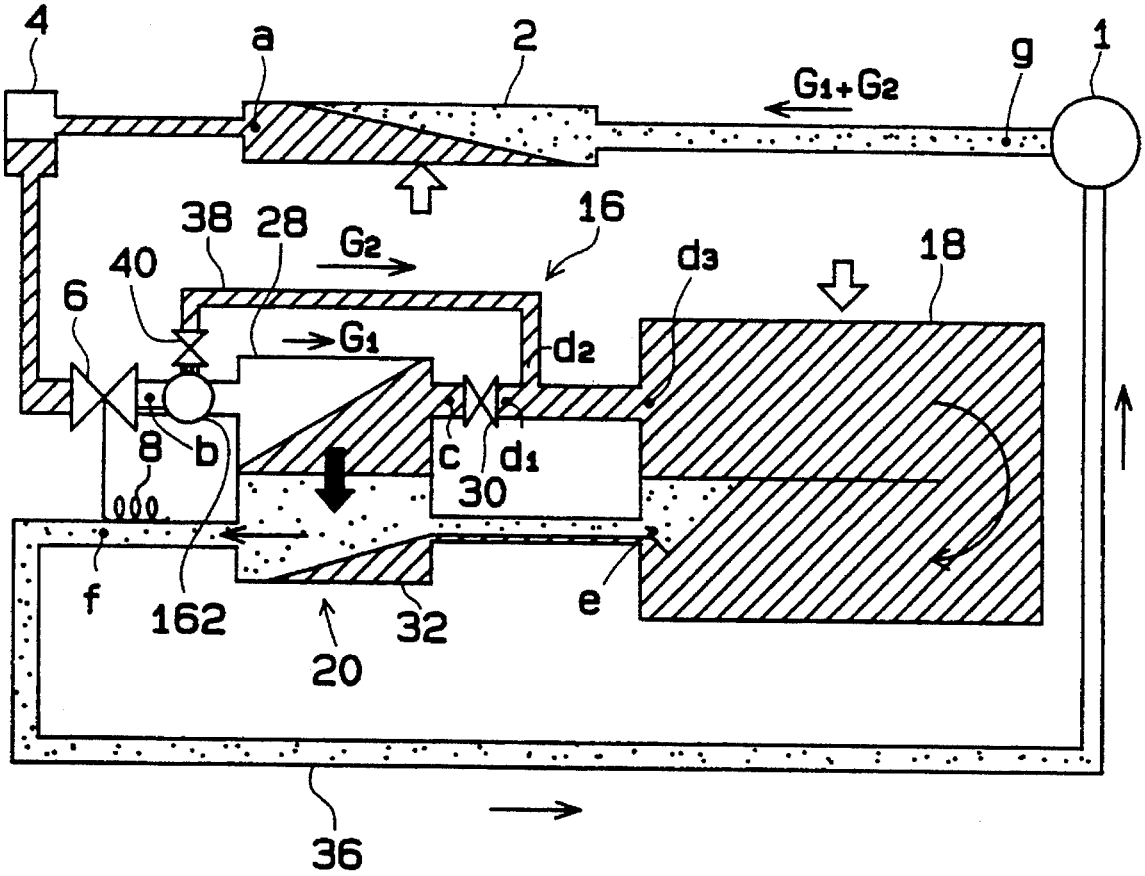
FIG. 25 is a schematic structural view of a refrigerating cycle to which an evaporator for cooling units of the fifth embodiment is applied.

The fifth embodiment will be described in reference to FIGS. 25 and 26.

In the fifth embodiment, a gas-liquid separator 162 is set in between an expansion valve 6 and a heat exchange part 20 to separate the gas-liquid two phase refrigerant into a gaseous refrigerant and a liquid refrigerant, and one end of a bypass passage 38 is connected to the gas-liquid separator 162 to allow the inflow of the liquid refrigerant separated by the gas-liquid separator 162 into the bypass passage 38. Incidentally, in the bypass passage 38, not only a second throttle 40 is set in but also the switch valve 140 as per above description may be set in, and this structure is enforceable in the same way.

Figure 16:
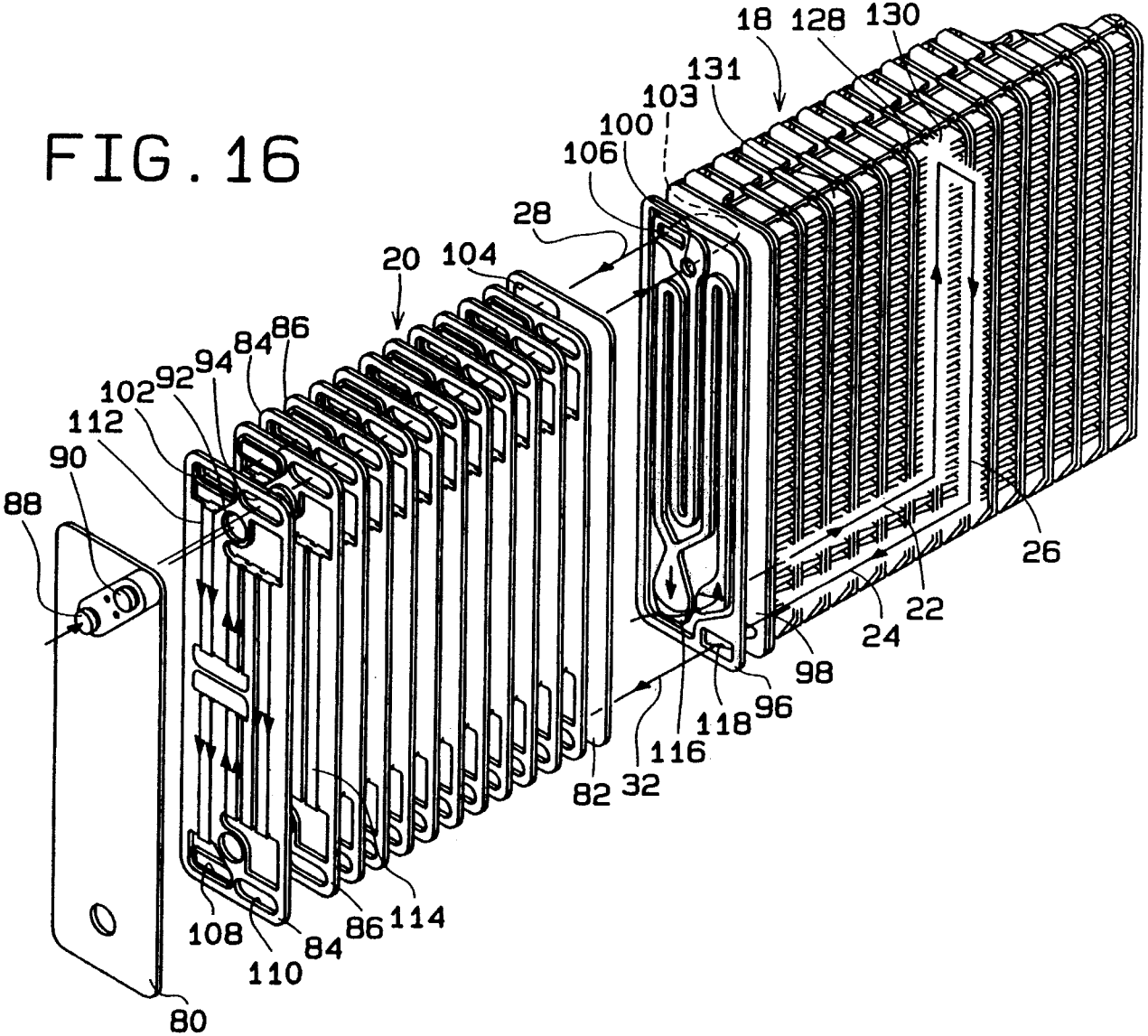
FIG. 16 is a fragmentarily exploded perspective view of an evaporator of the third embodiment.

As described in the above referring to FIGS. 16, 17 and 18, when the refrigerant, which has flowed through the first and second plates 84 and 86 and the inflow port 92 (partly illustrated) of the second side plate 82, flows through the through port 100 of the capillary plate 96. Then, when the refrigerant flows through the passage 103 into the link port 106, the refrigerant collides against the partition plate 98. The gas-liquid separator 162 is structured so that the refrigerant can be separated into a liquid refrigerant which flows into the second capillary passage 124 by gravity and a gaseous refrigerant which flows into the link port 106.

Figure 26:
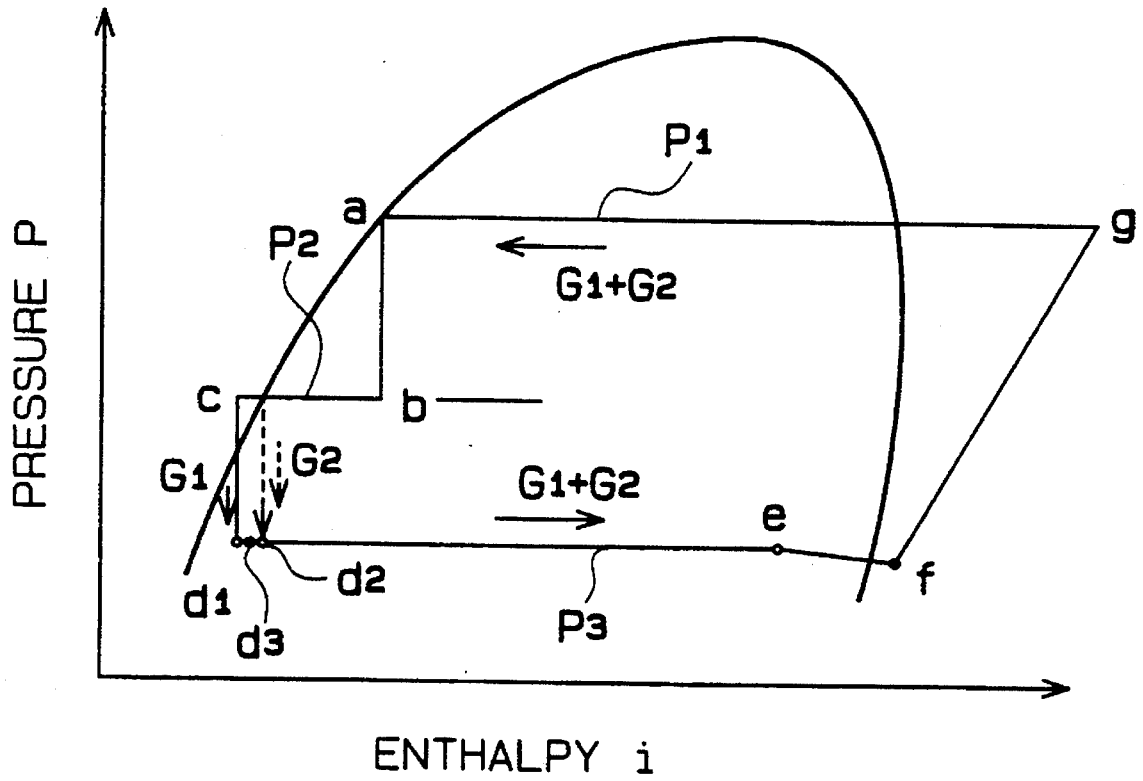
FIG. 26 is graph illustrating a Mollier diagram of the fifth embodiment.
Figure 27:
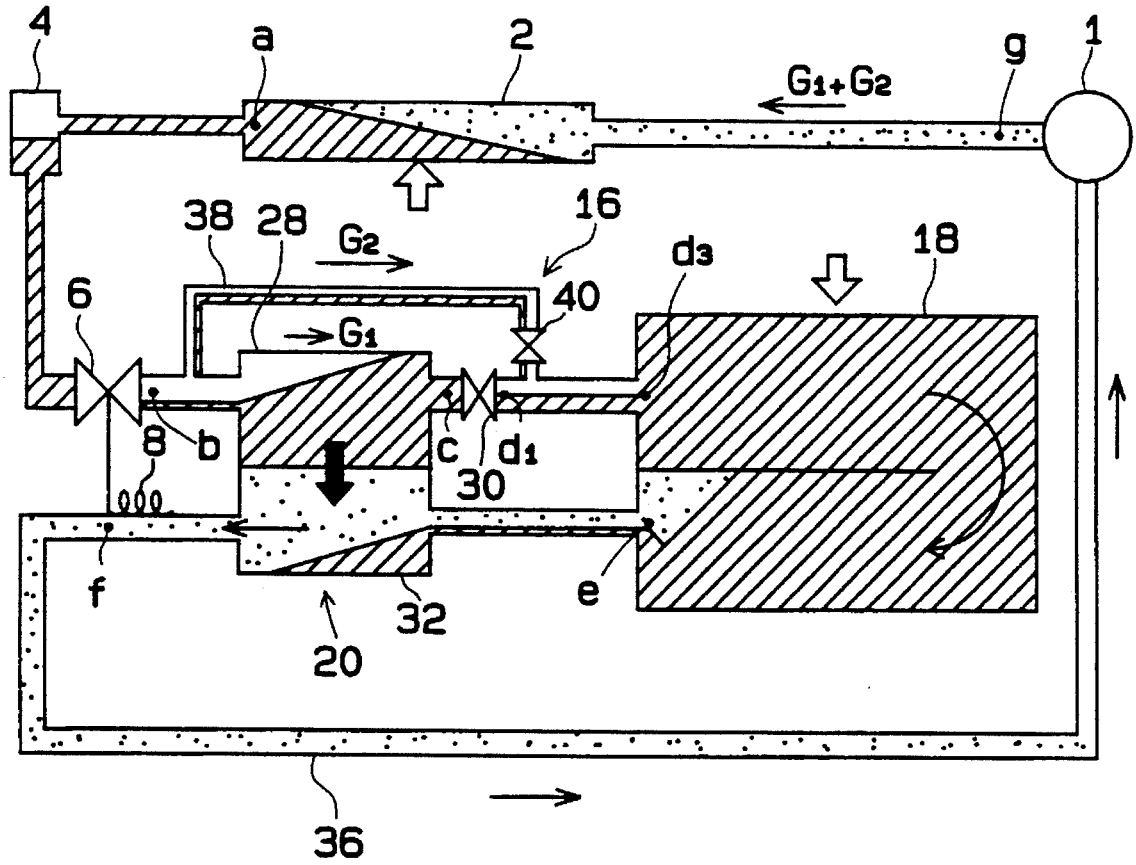
FIG. 27 is a schematic structural view of a refrigerating cycle to which an evaporator for cooling units of the sixth embodiment is applied.

Here, the operation of the gas liquid separator 162 is described referring to a Mollier diagram in FIG. 26. The liquified refrigerant G2 separated by the gas-liquid separator 162 is fed through the bypass passage 38, then subjected to pressure reduction by the second throttle 40, then joined to the refrigerant from the cooled passage 28, and then fed into an evaporation part 18 (from Point b to Point d2 and to Point d3). On the other hand, the gaseous refrigerant G1 separated by the gas-liquid separator 162 is fed through the cooled passage 28, then subjected to heat exchange and liquefaction, then subjected to pressure reduction by a first throttle 30, then joined to the refrigerant from the bypass passage 38, and then fed into the evaporation part 18 (from Point b to Point c, to Point d1 to Point d3).

The combined refrigerant fed into the evaporation part 18, G1+G2, is, as compared with the embodiment illustrated in FIG. 12 which is not provided with a gas-liquid separator 162, can be distributed more evenly to each refrigerant passage 26 due to smaller dryness fraction.

The sixth embodiment will now be described using FIGS. 27 through 33.

As described in the above, in some cases when in the winter season or in the transient operation state, the refrigerant G1 flowing through the cooled passage 28 is gaseous, and, when the gaseous refrigerant G1 flows through the first throttle 30 at a high velocity, a noise of a jet stream may be caused.

Figure 28:
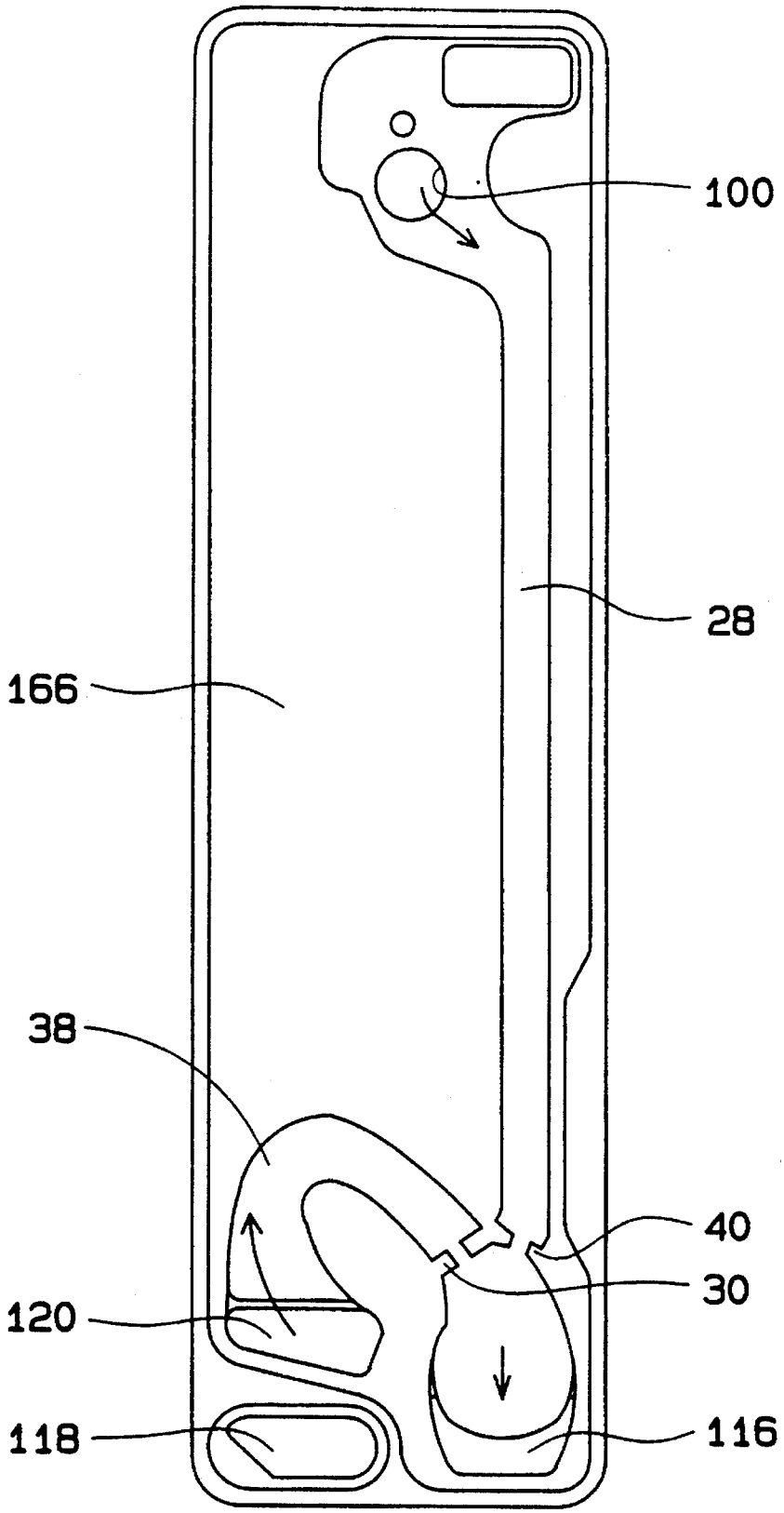
FIG. 28 is an expanded front view of an orifice plate of the sixth embodiment.
Figure 29:
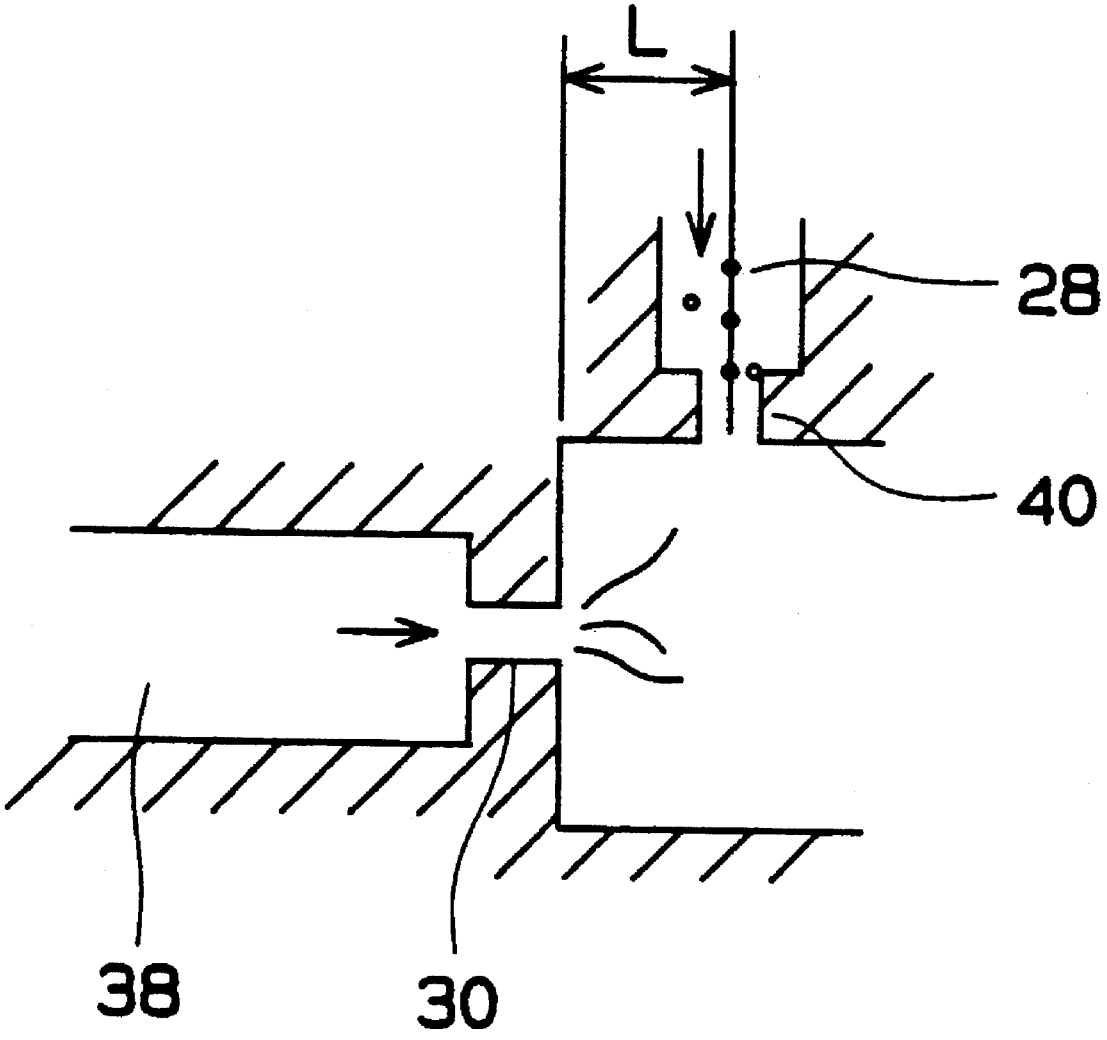
FIG. 29 is an illustrative view illustrating the relation between a first throttle and a second throttle of the sixth embodiment.

In order to avoid the jet stream noise, an orifice plate 166 is stacked instead of the aforementioned capillary plate 96, and a second throttle 40 is formed immediately after a first throttle 30 formed at the orifice plate 166 to allow a confluence. As illustrated in FIG. 29, it should preferably be so arranged that the distance L from the outlet of the first throttle 30 to the center of the second throttle 40 is five times or less as much as the throttle diameter D of the first throttle 30. Incidentally, FIG. 28 illustrates a counterpart of FIG. 18 viewed from the rear.

Figure 30:
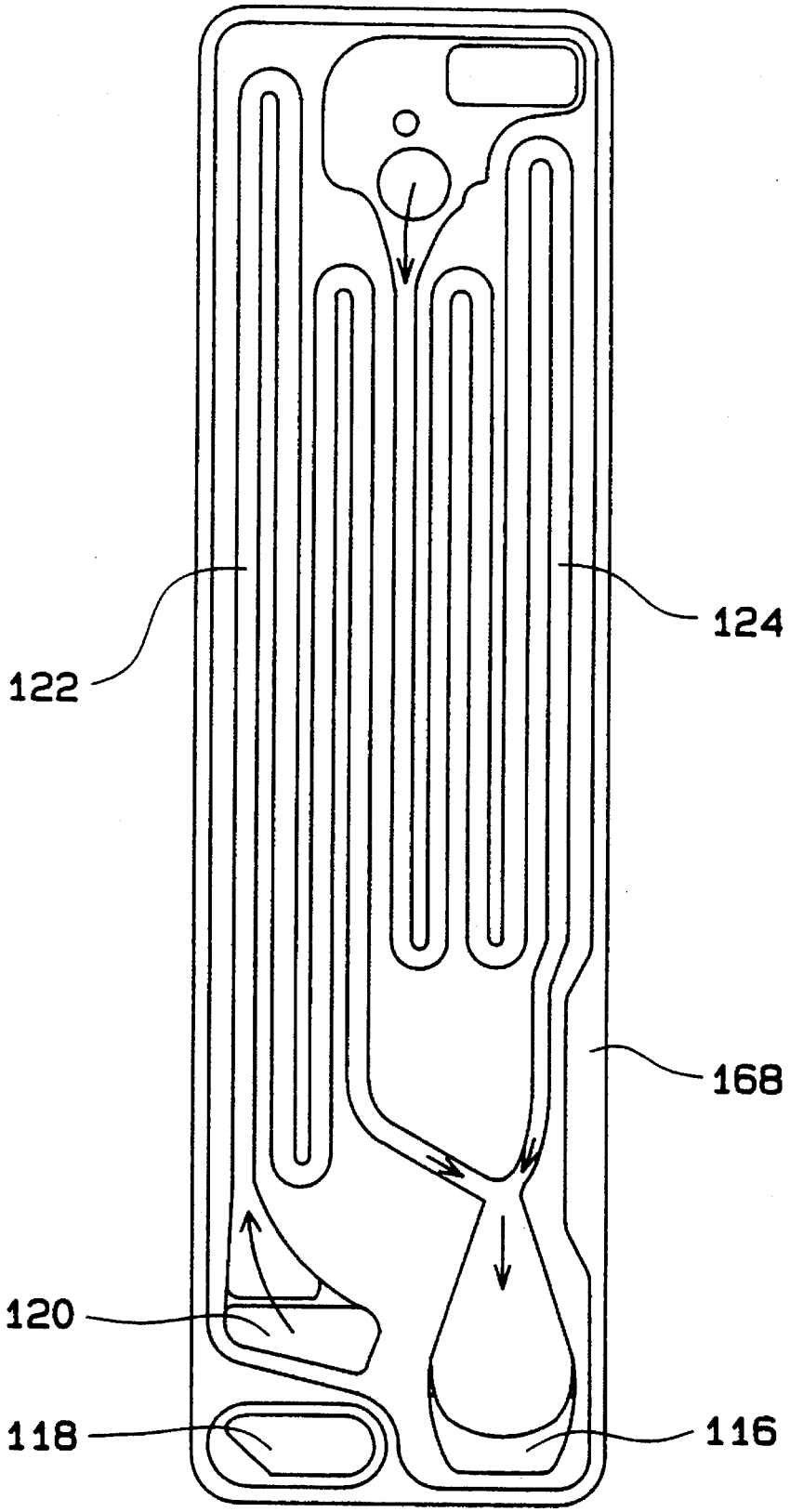
FIG. 30 is an expanded front view of a capillary plate of the sixth embodiment.
Figure 31:
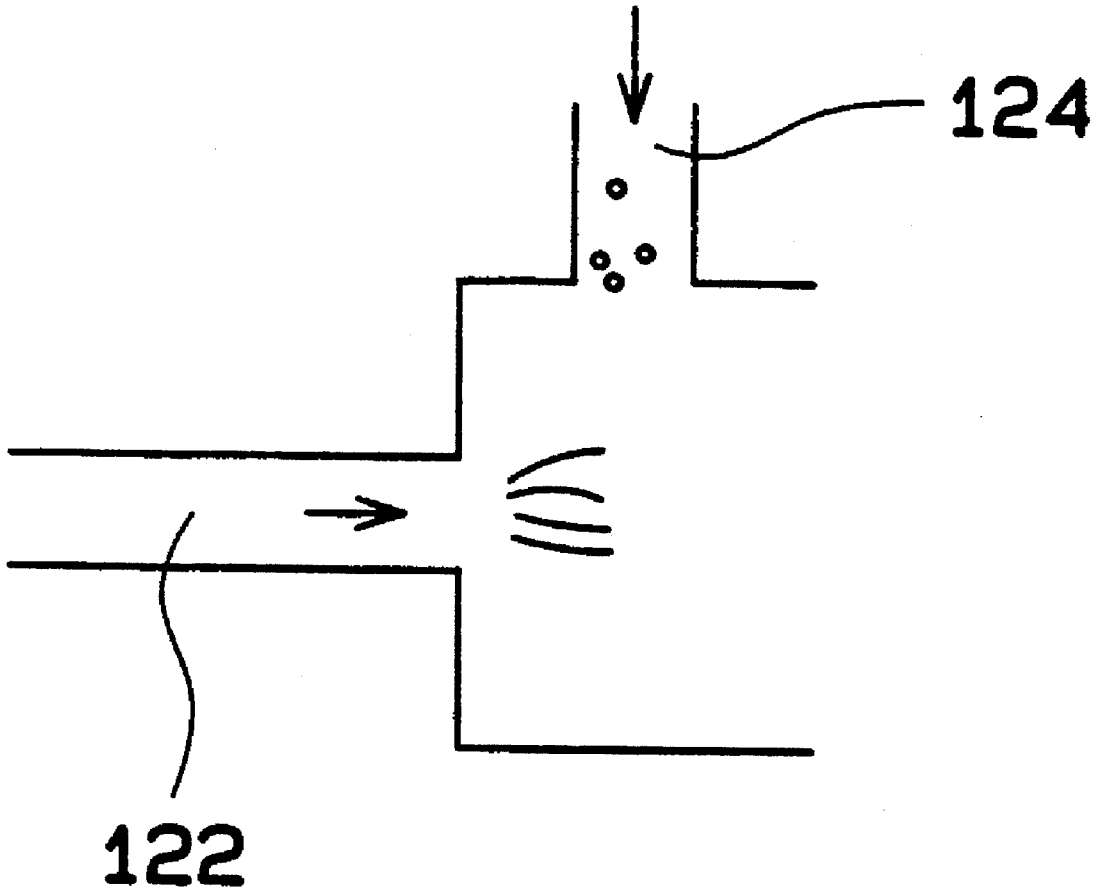
FIG. 31 is an illustrative view illustrating the relation between a first capillary passage and a second capillary passage of the sixth embodiment.

When the aforementioned first and second capillary passages 122 and 124 are formed instead of the first and second throttles 30 and 40, as illustrated in FIGS. 30 and 31, the first and second capillary passages 122 and 124 are joined so that the jet stream from the first capillary passage 122 can be broken by the liquid refrigerant from the second capillary passage 124. It should preferably be arranged so that the outflow direction of the first capillary passage 122 can cross the outflow direction from the second capillary passage 124 at right angles. Incidentally, FIG. 30 illustrates a counterpart of FIG. 18 viewed from the rear.

Figure 32:
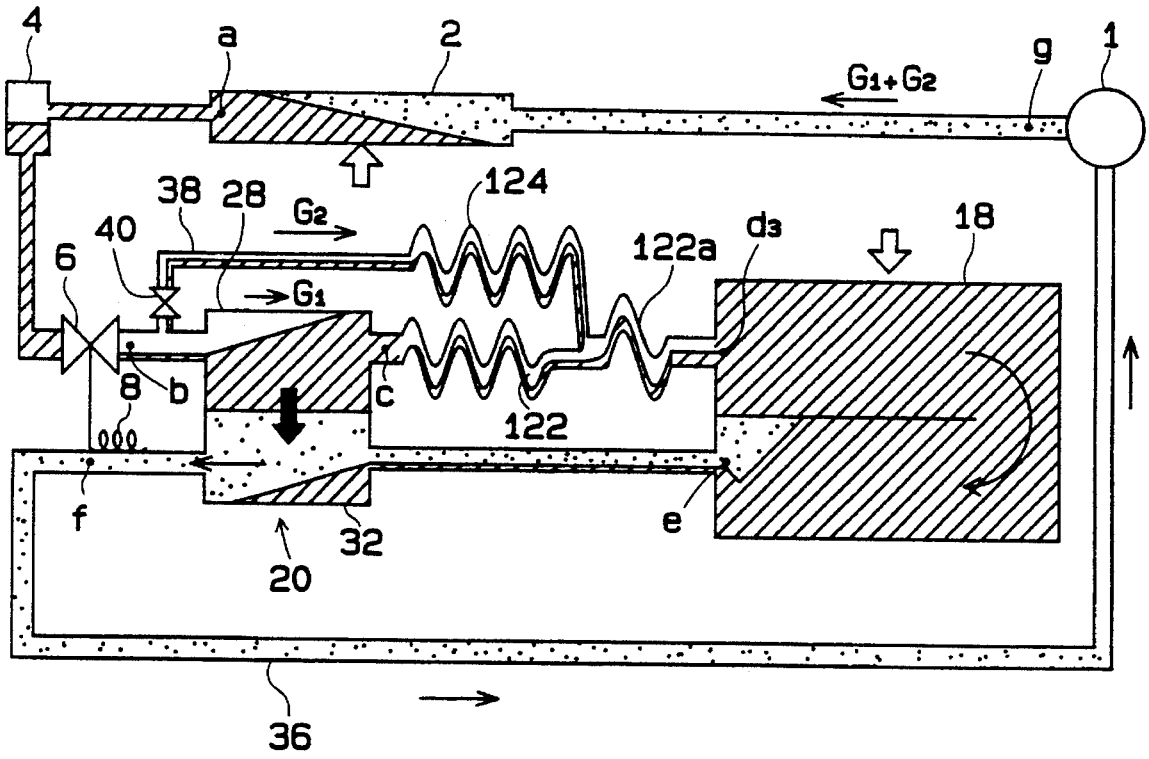
FIG. 32 is a schematic structural view of a refrigerating cycle to which an evaporator for cooling units of the sixth embodiment is applied.
Figure 33:
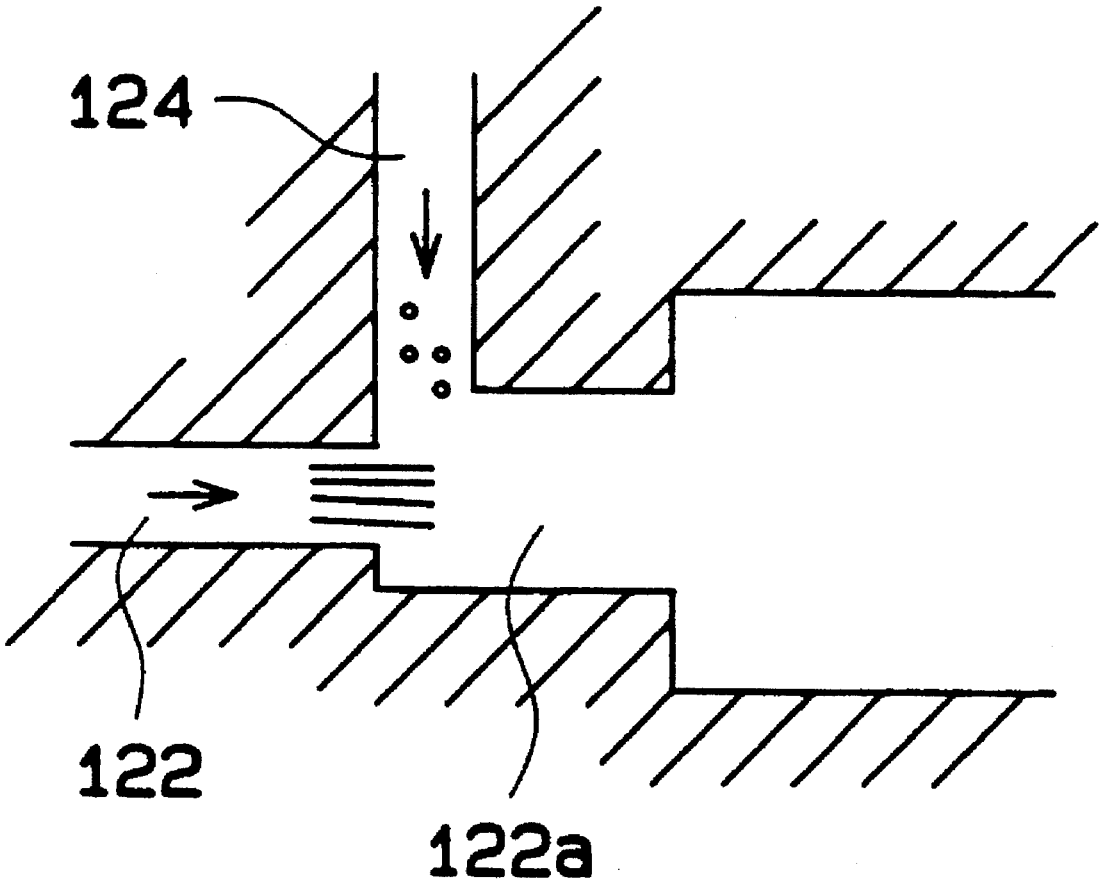

Alternatively, when the second capillary passage 124 is joined to the way of the first capillary passage 122, as illustrated in FIG. 32, 33 and 18, the distance of the first capillary passage 122 after the confluence, i.e., a passage 122*a*, should preferably be determined so that the liquid refrigerant and the gaseous refrigerant can be mixed and the liquid refrigerant can be heated by the gaseous refrigerant but the liquid refrigerant can not be evaporated out (e.g., 50 mm or less).

In the above arrangement, the jet stream caused by the first throttle 30 is broken by the liquid refrigerant from the bypass passage 28, G2, and, as a result, the jet stream noise can be reduced.

Finally, the seventh embodiment, which has a different arrangement to reduce the jet stream noise, will be described referring to FIGS. 34, 35 and 36.

Figure 34:
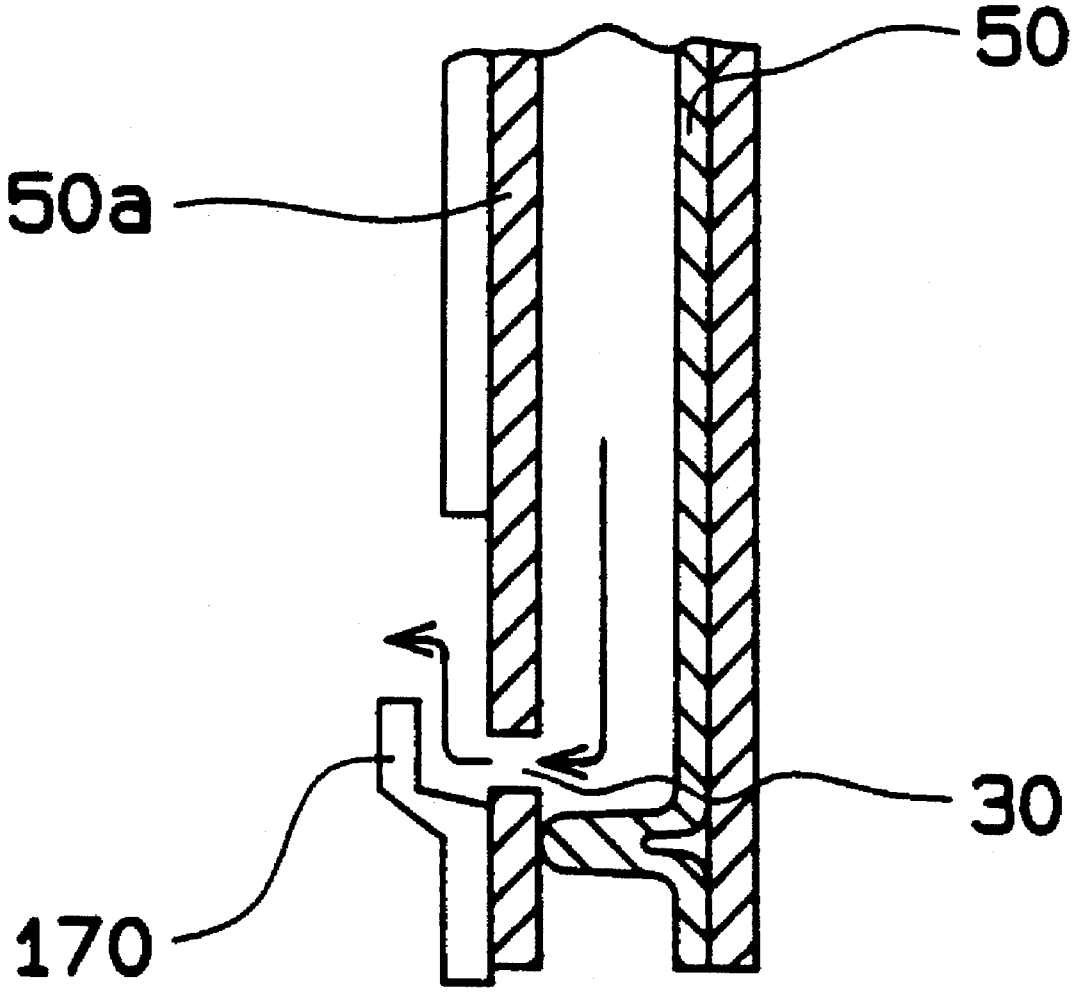
FIG. 34 is a fragmentarily expanded cross-sectional view illustrating an important part when an orifice is used as a first throttle of the seventh embodiment.

As illustrated in FIG. 34, when an orifice is used as a first throttle 30, a wall 170 is provided in the outflow direction from the first throttle 30. The wall 170 is arranged so as to stand against the outflow of the refrigerant from the first throttle 30 at a distance of five times or less as much as the diameter of the first throttle 30, D.

Figure 35:
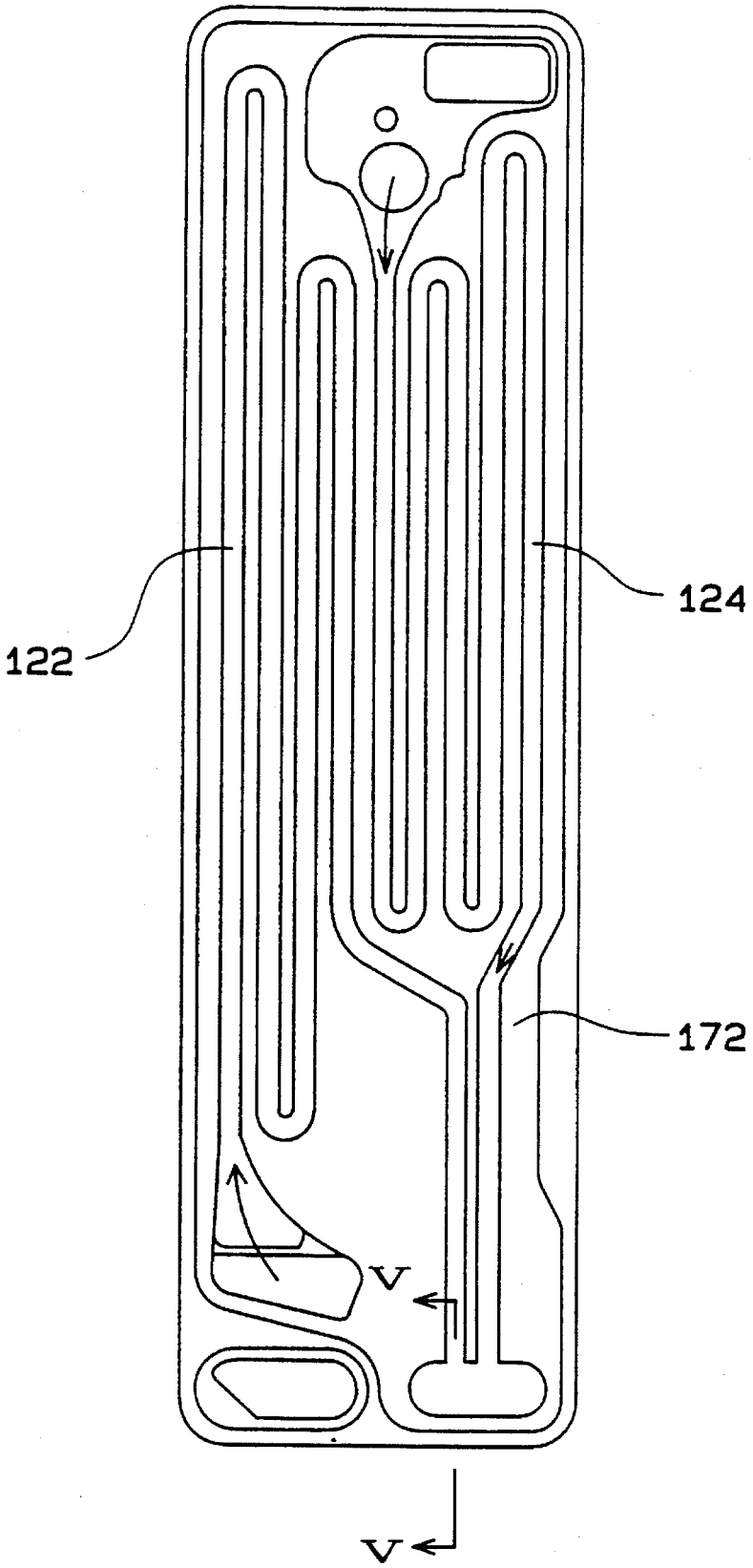
FIG. 35 is an expanded front view of a capillary plate of the seventh embodiment.
Figure 36:
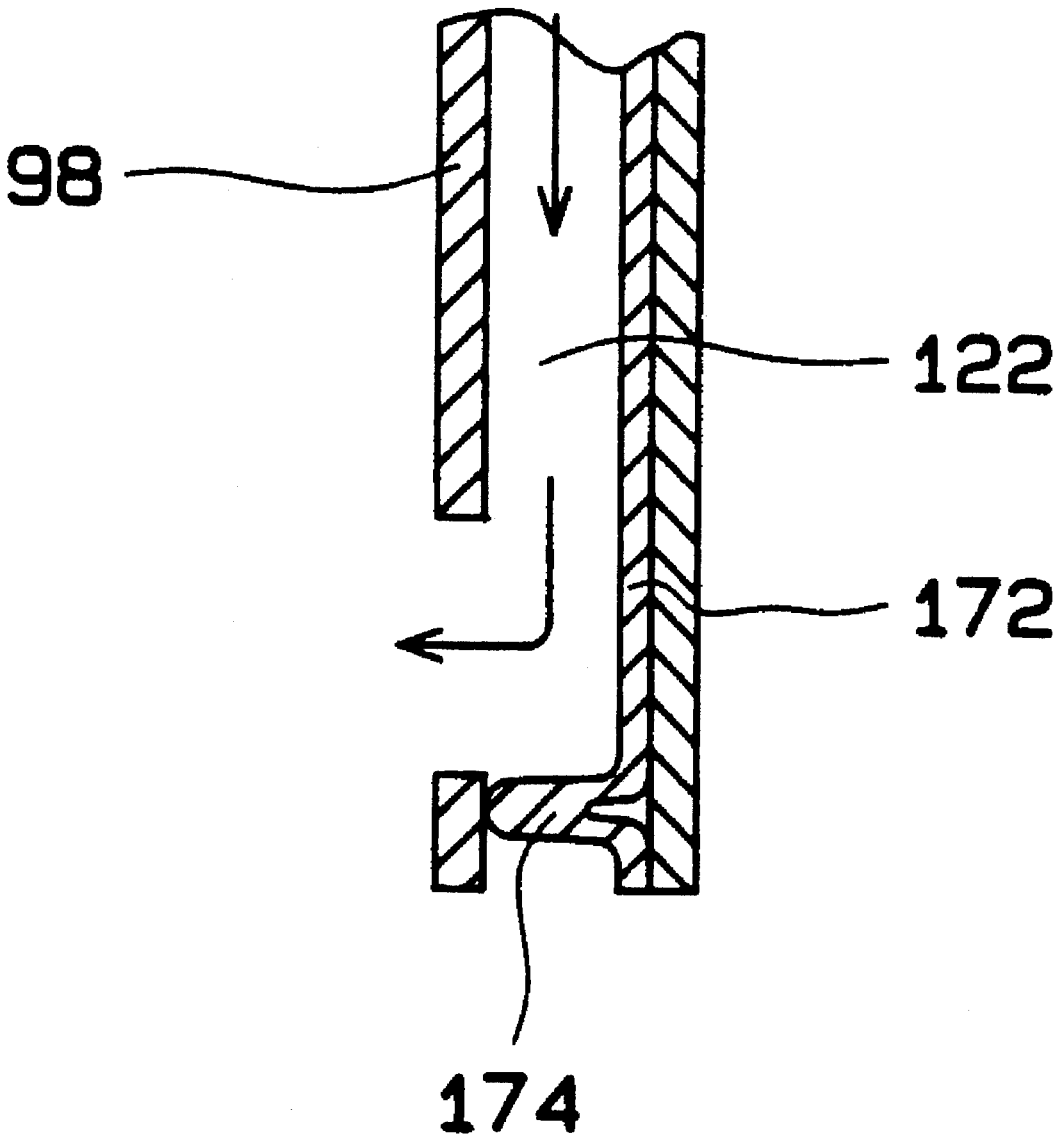
FIG. 36 is an expanded cross-sectional view taken along line V—V of FIG. 35.

Alternatively, as illustrated in FIGS. 35 and 36, when a first capillary passage 122 is used instead of the first throttle 30, a wall 174 is provided in the outflow direction from the first capillary passage 122. The wall 174 is arranged so as to stand against the outflow of the refrigerant from the first capillary passage 122 at a distance of 5 times or less as much as the diameter of the first capillary passage 122, D.

By providing the walls 170 or 174 as described in the above to prevent the jet stream, the jet stream noise can be prevented.

Although seven embodiments of the present invention have been described heretofore, it should be apparent to those skilled in the art that the present invention may be embodied in many other forms without departing from the spirit or the scope of the invention.

What is claimed is:

1. An evaporator for cooling units to be installed in the downstream from a pressure reducing value in a refrigerating cycle for circulating refrigerant, said evaporator comprising:

an evaporation part having an inflow passage and an outflow passage which are connected in parallel with each other through a plurality of refrigerant passages;

a heat exchange part having a cooled passage which links said pressure reducing valve and said inflow passage and a cooling passage which is connected to said outflow passage and leads said refrigerant to an outlet, said cooled passage being in heat exchange relationship with said cooling passage;

a first throttle set in said refrigerant passage in the downstream from the cooled passage of said heat exchange part;

a second throttle set in a bypass passage which detours at least said heat exchange part and said first throttle.

2. The evaporator for cooling units according to claim 1, wherein said bypass passage is branched from between said pressure reducing valve and said heat exchange part.

3. The evaporator for cooling units according to claim 1, wherein said bypass passage is branched from the upstream from said pressure reducing valve.

4. The evaporator for cooling units according to claim 3, wherein said second throttle disposed in said bypass passage is a switching valve for switching between an opening state and a closing state when a pressure difference between the upstream and the downstream becomes a preset amount or more.

5. The evaporator for cooling units according to claim 3, further comprising a switching valve for switching between an opening state and a closing state when a pressure difference between the upstream and the downstream becomes a preset amount or more.

6. The refrigerating cycle unit according to claim 5, further comprising:

a gas-liquid separating means disposed in the downstream of said pressure reducing means for separating the refrigerant in the gas-liquid two phase state into a gas refrigerant and a liquid refrigerant so that the liquid refrigerant separated by said gas-liquid separating means flow into said bypass passage.

7. The refrigerating cycle unit according to claim 5, further comprising a means provided in the downstream from said first throttle for controlling the occurrence of the jet stream of said refrigerant flowed through said first throttle.

8. The refrigerating cycle unit according to claim 5, further comprising:

a gas-liquid separating means disposed in the downstream of said pressure reducing means for separating the refrigerant in the gas-liquid two phase state into a gas refrigerant and a liquid refrigerant so that the liquid refrigerant separated by said gas-liquid separating means flows into said bypass passage.

9. The refrigerating cycle unit according to claim 5, further comprising a means provided in the downstream from said first throttle for controlling the occurrence of the jet stream of said refrigerant flowed through said first throttle.

10. The evaporator for cooling units according to claim 1, 2 or 3, further comprising a switch valve which closes when the pressure difference between the upstream and the downstream becomes the preset amount or more in said bypass passage.

11. The evaporator for cooling units according to claim 10, further comprising a gas-liquid separator which separates said refrigerant in the gas-liquid two phase state into a gaseous refrigerant and a liquid refrigerant in said cooled passage between said pressure reducing valve and said heat exchange part, said liquid refrigerant separated by said gas-liquid separator being branched by being connected to said bypass passage so as to flow thereinto.

12. The evaporator for cooling units according to claim 1, wherein said bypass passage is joined to said cooled passage in the downstream from said first throttle so that the occurrence of a jet stream of said refrigerant flowed through said first throttle can be prevented.

13. The evaporator for cooling units according to claim 1, further comprising a wall against which a jet stream of the refrigerant flowed through said first throttle collides.

14. The evaporator for cooling units according to claim 1, wherein said second throttle disposed in said bypass passage is a switching valve for switching between an opening state and a closing state when a pressure difference between the upstream and the downstream becomes a preset amount or more.

15. The evaporator for cooling units according to claim 14, wherein said switching valve has a valve seat achieving a throttle function.

16. The evaporator for cooling units according to claim 1, further comprising a switching valve for switching between an opening state and a closing state when a pressure different between the upstream and the downstream becomes a preset amount or more.

17. A refrigerating cycle unit comprising:

a compressor for compressing and discharging refrigerant;

a condenser for condensing the refrigerant discharged from said compressor;

a pressure reducing means for pressure reducing and expansion of the liquid refrigerant condensed by said condenser;

an evaporation part for evaporating the pressure reduced refrigerant by said pressure reducing means;

a cooled passage for flowing the refrigerant flowed out of said pressure reducing means and flows into said evaporation part;

a cooling passage for flowing the refrigerant flowed out of said evaporation part and flows into said compressor;

a heat exchange part for performing heat exchange between the refrigerant flowing through said cooled passage and the refrigerant flowing through said cooling passage;

a first throttle provided downstream of said cooled passage;

a bypass passage detouring at last said cooled passage of said heat exchange part and said first throttle; and a second throttle provided in said bypass passage.

18. The refrigerating cycle unit according to claim 17, wherein said bypass passage is branched from between said pressure reducing means and said cooled passage.

19. The refrigerating cycle unit according to claim 17, wherein said bypass passage is branched from the upstream of said pressure reducing means.

* * * * *